US005144870A

United States Patent [19]

Nick

[11] Patent Number: 5,144,870

[45] Date of Patent: Sep. 8, 1992

[54] APPARATUS FOR SELECTIVELY INSTALLING FASTENERS

[76] Inventor: Edward V. Nick, 512 Lexington Ave., Fox River Grove, Ill. 60021

[21] Appl. No.: 778,774

[22] Filed: Oct. 18, 1991

[51] Int. Cl.[5] ..... B25B 23/06

[52] U.S. Cl. ..... 81/434; 81/57.37

[58] Field of Search ..... 81/57.37, 434, 435; 227/120

[56] References Cited

U.S. PATENT DOCUMENTS

| | | | |
|---|---|---|---|
| 1,945,741 | 2/1934 | Gray . | |
| 2,310,287 | 2/1943 | Hausbeck . | |
| 2,670,770 | 3/1954 | Potterton . | |
| 2,689,589 | 9/1954 | Allen et al. . | |
| 3,554,246 | 1/1971 | Halstead . | |
| 3,757,407 | 9/1973 | Bomar . | |
| 4,014,225 | 3/1977 | Letdegard et al. . | |
| 4,146,071 | 3/1979 | Mueller et al. . | |
| 4,167,229 | 9/1979 | Keusch et al. . | |
| 4,404,877 | 9/1983 | Mizuno et al. . | |
| 4,478,112 | 10/1984 | Moulton . | |
| 4,667,545 | 5/1987 | Gould et al. . | |
| 4,674,367 | 6/1987 | Aab et al. . | |
| 4,936,169 | 6/1990 | Parsons . | |
| 5,027,679 | 7/1991 | Kawashima et al. | 81/434 |
| 5,083,483 | 1/1992 | Takagi | 81/434 |

*Primary Examiner*—James G. Smith
*Attorney, Agent, or Firm*—Godfrey & Kahn

[57] ABSTRACT

An apparatus for selectively installing individual screws of a screw belt into a work surface, the apparatus including a rotational drive assembly; a housing borne by the rotational drive assembly, the housing including a screw engagement station; a driving assembly borne by the housing and engageable with the rotational drive assembly; a screw engagement assembly slideably borne by the housing and which is matingly engaged by the drive assembly and operable to urge individual screws into the screw engagement station; a releasable brake borne by the housing and which is operable to selectively secure the screw engagement assembly against motion in a predetermined direction; a positioning assembly borne by the housing and which is operable to releasably position an individual screw in substantially coaxial alignment relative to the rotational drive means whereby, during operation, the rotational drive means imparts motion to the driving assembly which drives the screw engagement assembly in a direction away from the screw engagement station, and wherein this same movement simultaneously causes a sequential advancement of the screw belt, and a severing of an individual screw from the screw belt, and wherein the releasable brake, when released, permits the screw engagement assembly to be moved in a direction toward the screw engagement station thereby engaging the screw which has been severed from the screw belt and advancing the screw into the screw engagement station where it is releasably received by the positioning assembly and subsequently engaged by the rotational drive means.

27 Claims, 11 Drawing Sheets

APPARATUS FOR SELECTIVELY INSTALLING FASTENERS

1. FIELD OF THE INVENTION

The present invention relates generally to an apparatus for selectively installing a plurality of fasteners that are joined together to form a continuous belt, and more particularly, to an apparatus which is operable to selectively sequence and position individual screws of a substantially continuous screw belt in a fashion which facilitates either the installation of these individual screws into a work piece, or the removal of these screws therefrom.

2. DESCRIPTION OF THE PRIOR ART

To meet the requirements and demands of modern industry to efficiently produce various articles of commerce, assorted power fastening tools have been developed to rapidly install fasteners into assorted work pieces. Tools of this type are well known in the art and are used to drive nails, screws and other similar types of fasteners. Heretofore, the prior art power fastening tools have included two general categories of mechanical designs. In the first design category, these prior art fastening tools have included a drive means for driving the fasteners, and a fastener feeding means, or assembly and which is made integral with the drive means, and wherein the drive means and the fastener feeding means are operable to function as one tool. In the second design category, these prior art power fastening tools have included two separate and distinct assemblies, that is, a drive assembly, and a fastener feeding assembly, which is detachably mounted thereto. In this regard, however, it should be understood that the fastener feeding assemblies of both prior art designs obviate the need for a worker to manually place or position the individual fasteners to be installed in a desired ready driving position during the fastener installation process.

The prior art power fastening tools have further included a variety of different types of automatic fastener feeding assemblies. For example, the prior art designs have employed fastener feeding assemblies which are powered by a motor driven belt, a biasing spring, and even gravitational force to automatically feed the fasteners which are to be installed. However, and while widely diverse in construction and operation, these same prior art power fastening tools are replete with a multiplicity of deficiencies and shortcomings which have detracted from their usefulness.

Foremost among the deficiencies of these prior art fastening tools is their apparent inability to easily remove an installed fastener from a work piece. More particularly, it should be understood that in these prior art fastening tools, fasteners are sequentially and automatically fed by the aforementioned feeding assemblies to a ready, driving position, to be engaged by the drive means, immediately after a previous fastener has been installed into the work piece. Therefore, and in the event the previous fastener is installed incorrectly by a worker or otherwise breaks, or if some other malfunction occurs during the fastener installation process, a worker is usually unable to retract the incorrectly installed fastener from the work piece because another fastener has been automatically advanced to the ready driving position. Therefore, a worker, when faced with this situation, is forced to switch to another tool to remove the fastener from the work piece. This, of course, results in costly delays in the manufacturing process, worker frustration, and fatigue.

Examples of prior art devices which utilize such fastener feeding mechanisms are found in U.S. Pat. Nos. 2,670,770; 2,689,589; 3,554,246; 3,757,407; 4,478,112; 4,667,545; and 4,674,367, respectively.

Another deficiency of the prior art power fastening tools is that they are inherently heavy and cumbersome to employ in most commercial environments. This is especially true for fastening tools of the first design category. As should be understood, and during industrial use, workers typically utilize these power fastening tools continually throughout a work shift, and for longer periods of time if overtime is anticipated. Further, and in the construction industry, workers, as a general matter, utilize power fastening tools of the types described above, to install plywood, dry wall, and similar materials on various surfaces which may, from time to time, be above the worker's head. This installation of construction materials of the type described usually requires that the worker employ the power fastening tool at arm's length away from his, or her body, or in some cases directly above his or her head for significant periods of time. Therefore, the weight and cumbersome characteristics of the prior art fastening tools reduces the efficiency of a worker by causing great fatigue.

Yet another deficiency of the power fastening tools of the first design category is their apparent inability to perform multiple functions during the manufacturing process. More particularly, these prior art power fastening tools are operable, generally speaking, only to install fasteners into a work surface and are not operable to perform multiple functions, such as, for example, drill a hole in a work surface. In view of this shortcoming, workers heretofore, have employed several tools to perform essentially similar tasks. This, of course, also reduces the efficiency of the manufacturing process.

As previously discussed, fastener feeding tools of the second design category have included two separate and distinct assemblies, that is, a drive assembly, and a fastener feeding assembly which is detachably mounted thereto. However, these same prior art power fastening tools are notably deficient in their relative inability to be mounted on, or used in combination with, drive assemblies of different designs. More particularly, the individual fastener feeding assemblies of these prior art fastening tools, while detachably mounted on the drive assembly, are affixed in such a fashion that for all practical purposes, this same assembly is nearly permanent. As should be understood, these mounting assemblies create problems when the associated fastener feeding assembly jams or malfunctions, or if the drive assembly fails. Under these circumstances, a worker may spend valuable production time releasing the fastener feeding assembly from the associated drive assembly to correct the identified malfunction. This inability to rapidly install or release a fastener feeding assembly from the associated drive means nearly always results in costly delays in the manufacturing process.

Yet another deficiency attendant with the prior art power fastening tools of both design categories is their complexity of design. More particularly, the fastener feeding assemblies of these same power fastening tools are extremely complex in their operation. This complexity of design, as should be understood, increases the likelihood that these fastener feeding assemblies will fail, jam, or otherwise malfunction during operation under typical industrial conditions which are often dusty, or conducted in a manner wherein debris generated from the work surface comes into immediate contact with the fastening tool. Further, and as should be readily apparent, the complex design of these fastener feeding assemblies increases the manufacturing costs for these same tools.

In addition to the significant shortcomings noted above, the prior art fastening tools are further deficient in their relative inability to utilize different types of fastener belts. More particularly, these prior art power fastening tools are typically operable to utilize a specially designed belt of fasteners for each of the respective power fastening tools. Therefore, and as a general matter, a belt of fasteners designed for one power fastening tool is not interchangeable with another power fastening tool.

Still another common problem encountered with the prior art power fastening tools is that their respective fastener feeding assemblies are usually driven by a drive means which is separate and distinct from the drive means which installs the fasteners. This is mechanically inefficient because duplicative power means are required to install each of the fasteners. This also increases the complexity of the design.

Therefore, it has long been known that it would be desirable to have an apparatus for selectively installing a plurality of fasteners, and which is particularly well suited for rapid operation, and which is further operable to permit a worker to retract an installed fastener from a work piece without requiring the worker to utilize another tool for this same operation and wherein the apparatus would be lightweight and maneuverable, and which also may be interchangeably mounted on a variety of different portable power tools.

OBJECTS AND SUMMARY OF THE INVENTION

Therefore, it is an object of the present invention to provide an improved apparatus for selectively installing individual fasteners.

Another object of the present invention is to provide such an apparatus which is operable to obtain the individual benefits to be derived from related prior art apparatuses and practices while avoiding the detriments individually associated therewith.

Another object of the present invention is to provide such an apparatus which is operable to facilitate removal of installed fasteners from a work piece during the fastener installation process.

Another object of the present invention is to provide such an apparatus that is lightweight and maneuverable and therefore reduces fatigue during the use thereof.

Another object of the present invention is to provide such an apparatus which includes a drive means which performs multiple functions.

Another object of the present invention is to provide such an apparatus which is of relatively moderate cost to purchase and maintain, and which further is inexpensive to operate.

Another object of the present invention is to provide such an apparatus which is characterized by ease of employment, and simplicity of construction.

Another object of the present invention is to provide such an apparatus which is operable to utilize screw belts having different configurations.

Another object of the present invention is to provide such an apparatus which utilizes the drive means of a power fastening tool, such as an electric drill, both to install a fastener into a work piece, and to power the associated fastener feeding assembly.

Further objects and advantages of the present invention are to provide improved elements and arrangements thereof in an apparatus for the purposes described which is dependable, economical, durable and fully effective in accomplishing its intended purposes.

These and other objects and advantages are achieved in an apparatus for selectively installing a plurality of screw type fasteners, the apparatus having a means for imparting rotational movement to the individual screw fasteners about their respective longitudinal axes; a housing borne on the rotation means and defining a path travel for the individual screw fasteners, the screw fasteners traveling from a first ready position to a second driving position; a drive assembly borne by the housing and reciprocally movable relative thereto, the drive assembly engaged by the rotation means; a screw engagement assembly borne by the housing and engaged by the drive assembly, and wherein the screw engagement assembly is movable along a path of travel toward the second driving position, and wherein the screw engagement assembly is operable, when moved toward the second driving position, to urge the individual screw fasteners into the second driving position; a brake borne by the housing and which is operable to releasably engage the screw engagement assembly, the brake restraining the screw engagement assembly against motion toward the second driving position, and when released, permitting movement of the screw engagement assembly toward the second driving position; a positioning assembly borne by the housing and operable to releasably secure the individual screw fasteners in the second driving position; and a means for releasing the individual screw fasteners from the positioning assembly upon engagement of the individual screw fasteners with the rotation means.

DETAILED DESCRIPTION OF THE PREFERRED EMBODIMENT

Figure 1:
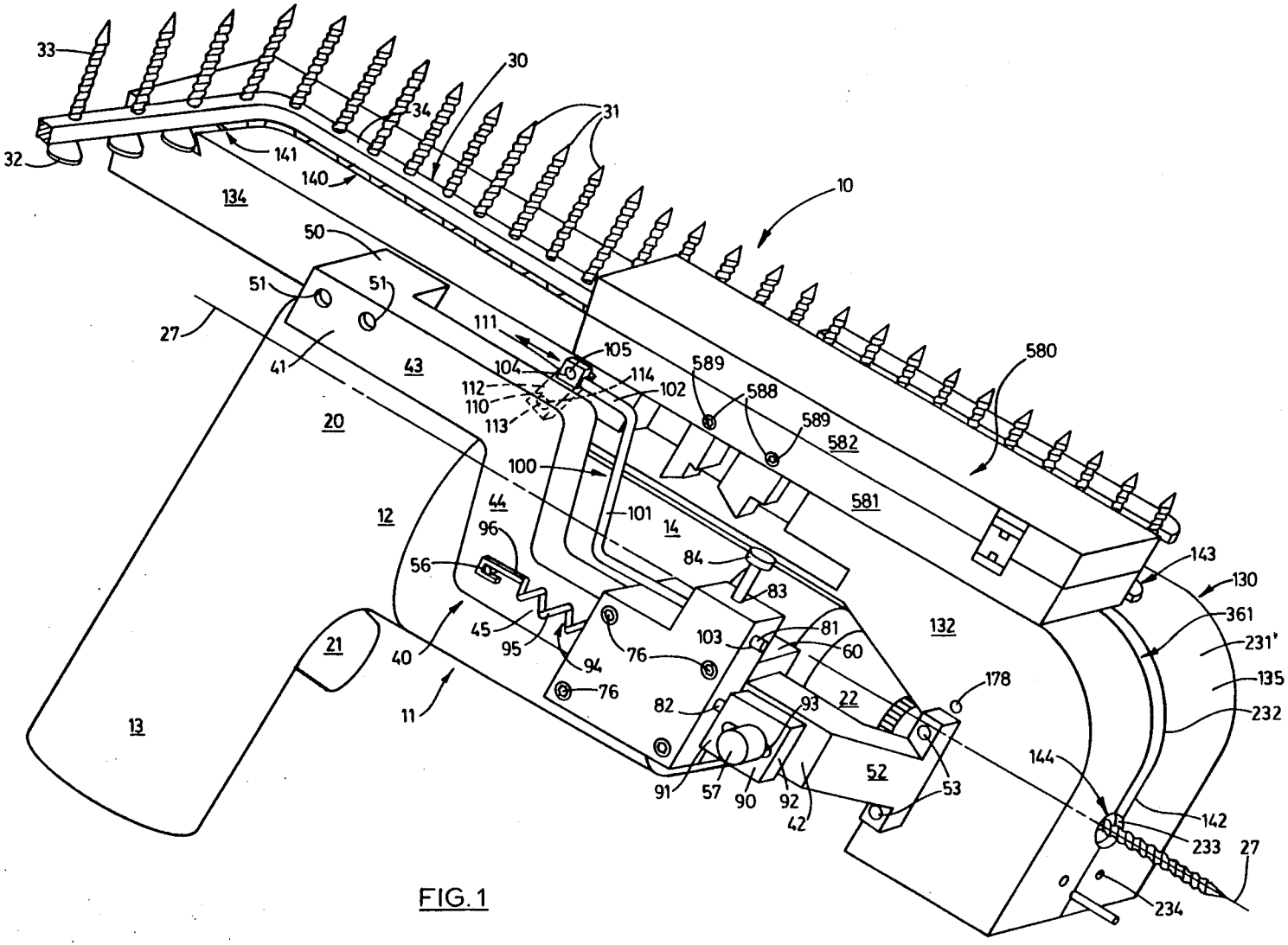
FIG. 1 is a right, perspective, environmental view of the apparatus of the subject invention shown in a typical operative configuration wherein it is mounted on a portable power drill.
Figure 2:
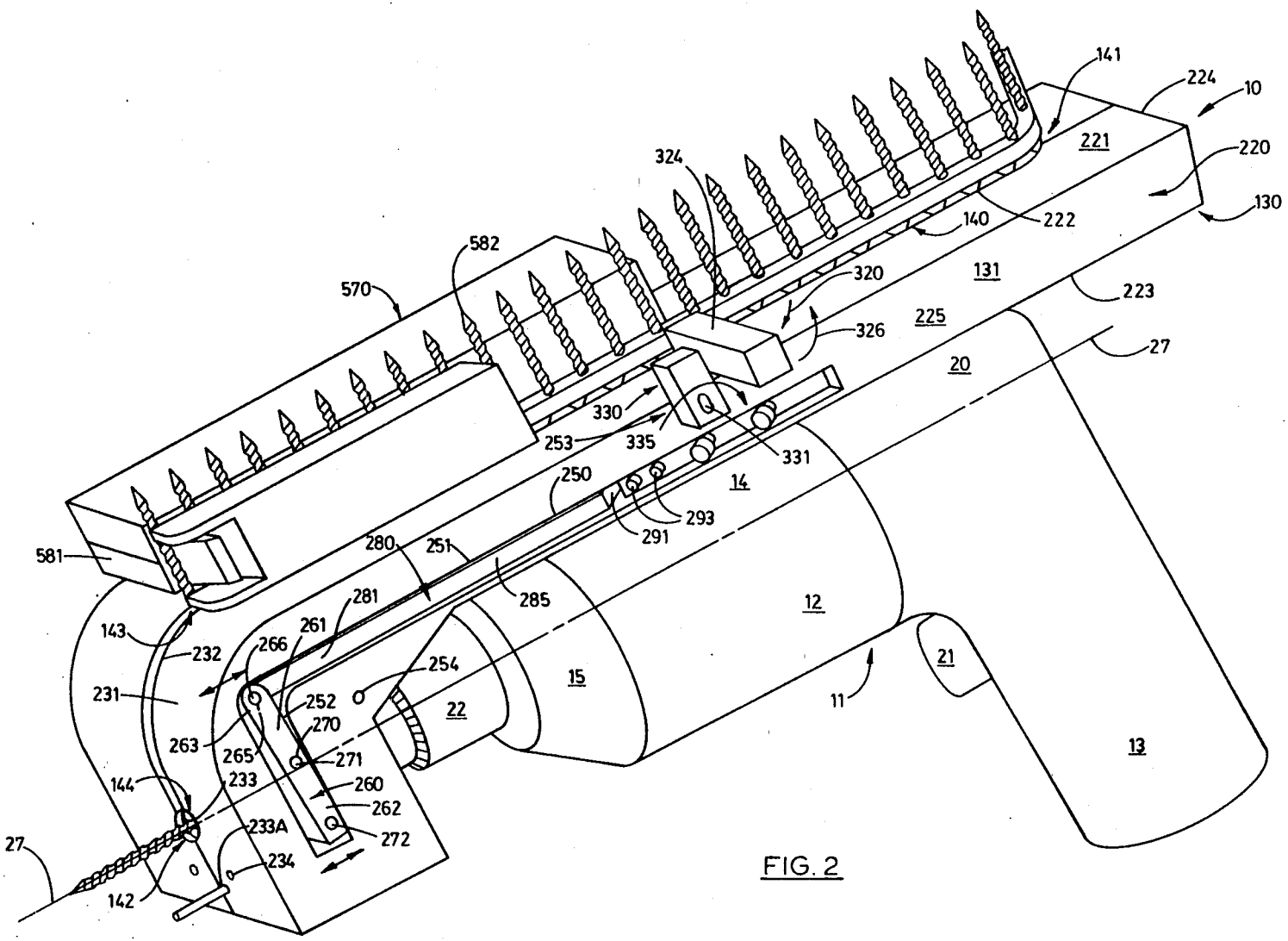
FIG. 2 is left, perspective, environmental view of the apparatus of the subject invention shown in a typical operative configuration wherein it is mounted on a portable power drill.
Figure 3:
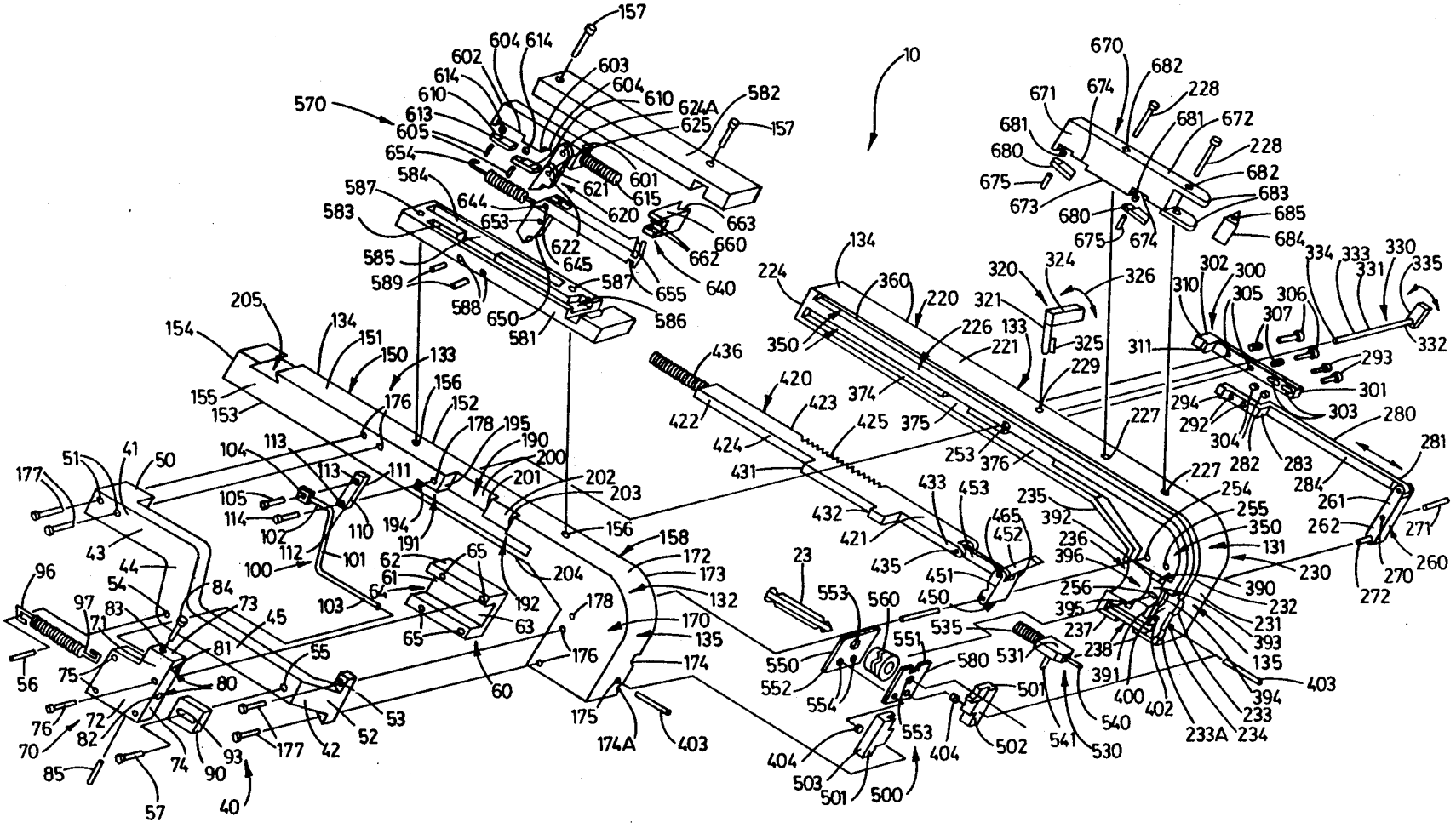
FIG. 3 is a perspective, exploded view of the apparatus of the subject invention shown in FIG. 1.
Figure 4:
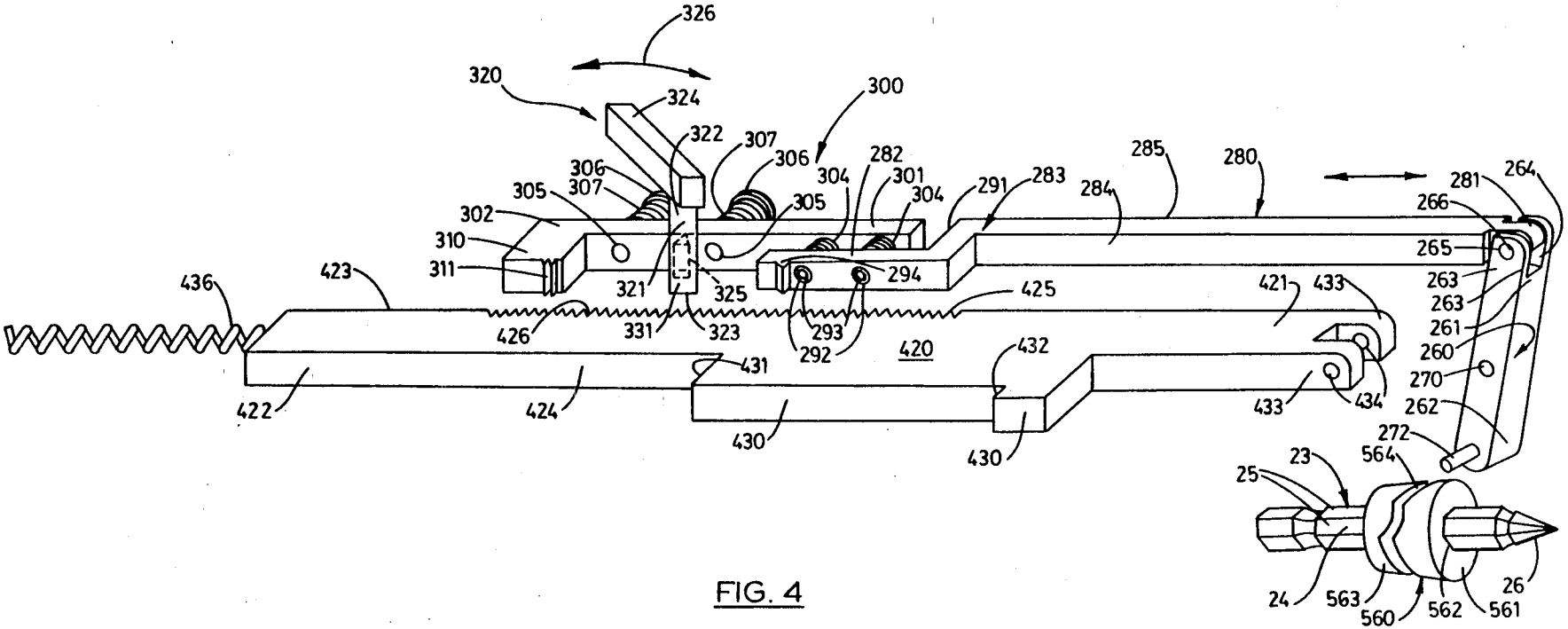
FIG. 4 is a partial, perspective, side elevation view of the apparatus of the subject invention, with supporting surfaces removed, and showing the drive assembly, which includes a drive arm, and drive bar, and further, a releasable brake, slide assembly, and spindle.

Referring more particularly to the drawings, the apparatus of the subject invention is generally indicated by the numeral 10 in FIGS. 1 and 2. As shown therein, the apparatus 10 is utilized in combination with a power drill 11, which is of conventional design. It should be understood that the power drill may be an electric drill or alternatively, it may be a drill which is driven by other sources of power, such as pressurized air, and the like. The drill 11 has a housing 12 which has affixed thereto, a handle 13. The housing has a top surface 14, a forwardly facing portion 15 and an opposite, rearwardly facing portion 20. Further, a moveable trigger 21 is mounted on the handle 13 and is operable to actuate the drill. As best seen in FIG. 1, a rotatable chuck 22 is borne by the housing and is connected in driving relation relative to a motor, not shown, and which is enclosed in the housing. The chuck 22 is of conventional design and is operable to receive, and secure, a bit 23 which is shown in FIGS. 3 and 4, respectively. The bit, which is also of conventional design, has an elongated main body 24 which is generally hexagonal in its cross-sectional shape and which is defined by a plurality of surfaces 25. Moreover, the main body 24 has a screw engagement surface 26 and which is adapted to engage a plurality of screws which will be discussed hereinafter. The drill 11 is operable to rotate the bit in both the clockwise and counterclockwise directions as requirements dictate. The bit is substantially coaxially aligned with a first, longitudinal line of reference which is indicated by the line labeled 27.

As best seen by reference to FIG. 1, the apparatus 10 of the subject invention is operable to utilize a screw belt and which is generally indicated by the numeral 30. The screw belt is of conventional design, and is adapted to position, or otherwise orient, a plurality of screws 31 in predetermined, spaced, juxtapositioned relationship. The screws 31 are of conventional design having a head 32 which may be engaged by the screw engagement surface 26 of the bit 23. Each of the screws further have a threaded shaft 33. The individual screws 31 are held in this predetermined spatial relationship, one to the other, by a belt 34 which is typically manufactured from assorted synthetic polymers which may be molded about the threaded shafts using conventional technology. As best illustrated by reference to FIG. 7, the apparatus 10 is operable to install the individual screws 31 into a work surface 35 which may include wallboard, plywood or other similar materials.

As best illustrated by reference to FIGS. 1 and 3, the apparatus 10 of the subject invention is removably mounted on the drill 11, and is rendered operable for slideable movement relative thereto, by a mounting assembly which is generally indicated by the numeral 40. The mounting assembly has opposite first and second ends 41 and 42, and is further defined by an upper portion 43; an angulated and substantially intermediate portion 44; and a lower portion 45. As best shown in FIG. 1, the intermediate portion 44 locates or positions the upper and lower portions in substantially parallel spaced relation, one to the other. The first end 41, of the mounting assembly, has a first support member 50, which positions the upper portion 43 in spaced relation relative to the housing of the apparatus and which will be discussed in further detail hereinafter. The first support member 50 has formed therein a pair of bores 51. Further, a second support member 52 is made integral with the second end 42 of the mounting assembly. It similarly has formed therein a pair of bores 53. As best illustrated by reference to FIG. 3, the lower portion 45 has formed therein a pair of threaded apertures 54 and 55, respectively. As best seen by reference to FIG. 1, a screw like fastener 56 is operable to matingly engage the threaded aperture 54 and extends generally normally outwardly relative to the lower portion. Further, and as discussed above, the aperture 55 is suitably threaded and receives a threaded fastener 57 of conventional design.

The mounting assembly 40 is secured on the housing 12 of the drill 11 by a mounting bracket which is generally indicated by the numeral 60. The mounting bracket has a generally U-shaped main body 61 which has an exterior facing surface 62 and an interior facing surface 63. The interior facing surface 63 defines a channel 64 which has predetermined longitudinal, and transverse dimensions. It should be understood that the transverse dimension of the channel is just slightly greater than the width dimension of the lower portion 45, of the mounting assembly. This dimensional relationship permits the lower portion 45 to slide, back and forth, within the channel as will hereinafter discussed in greater detail. A plurality of thread bores 65 are formed in the main body. This is best shown by reference to FIG. 3. It should be understood that the mounting bracket 60 is secured on the housing 12 of the drill by conventional fastening techniques, that is, the bracket may be formed integrally with the housing as by molding or the like or further, fasteners may secure the main body of the mounting bracket to the housing of the drill. Further, the mounting bracket may, for example, be made removable as by attaching a band or strap to the main body 61 and thereafter providing a suitable adjustment mechanism to bind or otherwise tighten the strap about the housing of the drill. In this fashion, an artisan may release the apparatus 10 and the associated mounting bracket from the drill in the event the apparatus is not required.

The lower portion 45 of the mounting assembly 40 is captured in the channel 64 of the mounting bracket 60 by a coverplate 70. The coverplate has upper and lower portions 71 and 72, respectively, and is further defined by a peripheral edge which includes an upper peripheral edge 73; and a forwardly facing peripheral edge 74. As best illustrated by reference to FIGS. 1 and 3, the coverplate has formed therein a plurality of threaded bores 75 which are operable to receive individual fasteners 76. The threaded bores 75 are individually positioned in a fashion whereby they are each disposed in substantially coaxial alignment relative to the individual bores 65 which are formed in the main body of the mounting bracket. It should be understood that the individual fasteners 76 are threadably advanced into each of the bores 65 thereby securing the coverplate to the main body. A pair of substantially longitudinally disposed channels or passageways 80 are formed in the coverplate. The pair of channels includes a first channel 81 and a second channel 82. Further, a threaded bore 83 is formed in the upper peripheral edge 73 and extends into the coverplate to a position wherein it is disposed in communication with the first channel 81. The threaded bore 83 is operable to receive a threaded fastener 84. Further, and as best seen by reference to FIG. 3, a channel or passageway not shown is formed in the bottom peripheral edge of the coverplate and is operable to frictionally engage a retaining pin 85.

As best seen by reference to FIGS. 1 and 3, a stop member, and which is generally indicated by the numeral 90, has a first end or engagement surface 91 and an opposite, second end 92. The stop member has formed therein a substantially elongated and generally cylindrically shaped channel 93 which extends therethrough. As best seen in FIG. 1, the threaded fastener 57 extends through the channel and into the threaded aperture 55. The apparatus 10, and more particularly the mounting assembly 40, includes a return spring 94. The return spring has a main body 95 which has opposite first and second ends 96 and 97, respectively. As should be understood, the second channel 82, which is formed in the coverplate 70, has a diametral dimension which is greater than the transverse dimension of the return spring. The return spring 94, and more particularly the second end thereof, is secured in the second channel 82 by the retaining pin 85. Further, the first end of the return spring is secured in place by the fastener 56. In operation, and when the apparatus 10 engages the work surface 35, the drill 11, which is mounted on the mounting bracket 60 continues to move in a forward direction relative to the apparatus 10. This movement of the drill continues until the mounting bracket comes into contact with the stop member 90. Upon removing the apparatus 10 from the work surface, the return spring 94 has the effect of urging the apparatus 10 in a forward direction and away from the drill. Therefore, it should be understood that by adjusting the stop member 90, an artisan can adjust the depth of penetration of the individual screws 31 which are being installed. The operation of the apparatus 10 will be discussed in significant detail hereinafter.

As best illustrated by reference to FIGS. 1 and 3, the apparatus 10 includes a linkage assembly which is generally indicated by the numeral 100 and which has a first member 101 of substantially angulated configuration. The first member has a first end 102 and an opposite second end 103. As best seen in FIG. 1, an aperture 104 is formed in the first end thereof and is operable to receive a suitable pin or fastener 105. Further, the linkage assembly 100 includes a second member 110 which has opposite first and second ends 111 and 112, respectively. The second member has a pair of apertures 113 formed therein, and more particularly, it has an aperture formed about its first end, and which is operable to receive the pin or fastener 105; and an aperture 113 is formed in its second end, and which is threaded, and which is operable to receive a suitable threaded fastener 114. The second end 103 of the first member 101 is received in the first channel 81 and is secured in place by the frictional engagement of the threaded fastener 84 therewith. In operation, and when the apparatus 10 is pressed against the work surface 35, the mounting assembly 40 permits the drill 11, as earlier discussed, to move towards the work surface. This corresponding movement has the effect of causing the first member 101 of the linkage assembly to urge the first end 111 of the second member 110 forwardly of the apparatus. The significance of this movement will be discussed in further detail hereinafter.

As best seen by reference to FIG. 3, the apparatus 10 of the subject invention has a housing 130 which includes a left half 131 and a right half 132. As a general matter, the left and right halves have overall shapes which are substantial mirror images of each other. The left and right halves 131 and 132, respectively, each have a main body 133 which includes a substantially elongated, and narrowly rectangular shaped first portion 134 and a second portion 135 which is generally oriented substantially transversely relative thereto. When assembled, and as best seen by reference to FIG. 1 the housing 130 defines a path of travel 140 for the screw belt 30. More particularly, the path of travel 140 extends from a proximal, first, or intake end 141 to a, distal, discharge, or second end 142. Further, and along this same path of travel, the individual screws are severed from the belt 34. Once they are severed from the screw belt, the apparatus 10 is operable to move the individual severed screws from a first, ready position 143 to a second, driving position 144. The movement of the screw belt along the path of travel as well as the severing of the individual screws from the belt will be discussed in further detail hereinafter.

As best understood by a study of FIGS. 1, 2 and 3, the left and right halves 131, and 132 of the housing 130 both have a generally similar overall shape, however, the exterior facing surfaces are somewhat different as will be discussed below. Further, it should be understood that the internal cavities are substantially identical, one to the other. In connection with the description of the right half 132 of the housing 130, it should be understood that the cavity of same is not shown. However, an understanding of this cavity will be gained when this same cavity is described in connection with the left half 131. Furthermore, and to assist in understanding the present invention, it should be understood that all apertures, or other bores, either, threaded or smooth, unless indicated to the contrary, are generally oriented substantially perpendicular relative to the supporting surface in which they are formed.

The right half 132 of the housing 130 and more particularly the first portion 134 thereof, has a top surface 151 which is defined by a peripheral edge 152. Further, the first portion of the right half has a bottom surface 153, a rear wall 154 and an exterior facing or outwardly disposed sidewall 155. The sidewall 155 is oriented generally perpendicular to the top surface 151. As best seen by reference to FIG. 3, a pair of threaded apertures, or channels 156 are formed in the top surface and are operable to matingly engage suitable fasteners 157. The main body 150 further has an interior or inside facing surface 158 which defines a plurality of cavities which will be discussed in further detail hereinafter. Further, the second portion 135 of the right housing 132 has a substantially curved and forwardly facing surface 172 which is defined by a peripheral edge 173. Further, and as best seen by reference to FIG. 1, a substantially semicircular shaped aperture 174 is formed in the peripheral edge and is disposed in close proximity to the second driving position 144. As best seen in FIG. 3, a smooth bore 175 is formed in the forwardly facing surface 172 and is disposed just slightly below the semicircular aperture 174. A second, smaller semicircular shaped aperture 174A is formed in the peripheral edge. In addition to the foregoing, two pairs of threaded apertures 176 are formed in the exterior sidewall 155 and disposed in predetermined space relation one pair to the other, such that they may be coaxially aligned with the pairs of bores 51 and 53, respectively, and which are formed in the mounting assembly 40. When appropriately aligned, two pairs of threaded fasteners 177 are threadably engaged therewith thereby securing the mounting assembly to the right half 132 of the housing 130. The exterior facing sidewall 155 further has formed therein a pair of smooth bores 178. The significance of these particular bores will be discussed in greater detail hereinafter. The second portion additionally includes a rearwardly facing wall, or surface 180, and which has formed therein a semi-circular aperture, which is not shown.

Formed in the top surface 151 and the exterior facing sidewall 155 is an indexing cavity which is generally indicated by the numeral 190. The indexing cavity has a bottom surface 191 which is substantially parallel to the top surface 151 and further has a first end 192 and an opposite or second end 193. The indexing cavity 190 is defined by first, second, third, fourth, fifth, sixth and seventh sidewalls and which are hereinafter designated by the numeral 194, 195, 200, 201, 202, 203 and 204, respectively. Sidewalls 195, 200, 201, 202, and 203 are disposed in spaced relation relative to the bottom surface 191. It should be understood that each of the individual sidewalls defines a surface which is contacted or otherwise engaged by other assemblies which will be discussed hereinafter. In addition to the foregoing, it should be understood that the individual surfaces are positioned substantially normally relative to the adjoining surfaces. The significance of the indexing cavity will become readily apparent hereinafter. Further, and formed in the top surface 151 and the sidewall 155 is a passageway 205 which is operable to receive the heads 32 of the individual screw 31. It should be understood that this passageway is just slightly greater in size than the heads of the screws thereby allowing the belt of screws 30 to slide therethrough.

The first portion 134, of the left half 131, of the housing 130, has a main body 220 which includes a top surface 221, and which is defined by a peripheral edge 222. Further, the main body 220 has an opposite bottom surface 223, which is disposed in substantially parallel, spaced relationship, to the top surface 221. Additionally, the main body includes a rear wall 224, an exterior facing sidewall 225, and an interior facing sidewall 226. As best seen by reference to FIG. 3, a pair of threaded apertures 227 are formed in the top surface and are operable to matingly engage a pair of threaded fasteners 228. Further, a smooth bore 229 is formed in a predetermined location in the top surface 221. The second portion 135 of the left half of the housing has a main body 230 which has a curved or forwardly facing surface 231 and which is defined by a peripheral edge 232. Further, semicircular apertures 233 and 233A are formed in the peripheral edge 232. Additionally, and positioned between the semicircular apertures is a smooth bore 234 which is formed in the forwardly facing surface 231. As best seen by reference to FIG. 7, the main body 230 has a rearwardly facing surface 235 which has formed therein a semicircular shaped aperture 236 of predetermined dimensions. Additionally, the main body has a bottom surface 237 which has formed therein an elongated, and narrowly rectangular shaped aperture 238. The significance of apertures 236 and 238 will be discussed in further detail hereinafter.

As best understood by a comparative study of FIGS. 2 and 3, the exterior facing sidewall 225, has formed therein, a drive cavity and which is generally indicated by the numeral 250. The drive cavity is defined by a first, substantially horizontally disposed component 251 and a second substantially vertically or right angularly disposed component 252. Referring more particularly to FIG. 3, it should be understood that the exterior facing sidewall has several bores formed therein. In particular, the exterior facing sidewall has smooth bores 253 and 254 formed therein, as well as a threaded bore 255. Further, an elongated and substantially cylindrically shaped aperture 25 is formed in the exterior sidewall and is oriented generally parallel to the top surface 221. Additionally, a pair of threaded apertures, not shown, are formed in the drive cavity and are operable to receive individual threaded fasteners. The significance of those apertures will be discussed hereinafter.

As best understood by a study of FIGS. 2, 3 and 4, respectively, the apparatus 10 of the subject invention has a drive arm 260 which is positioned in the second vertical component 252 of the drive cavity 250. More particularly, the drive arm has a first end 261 and an opposite second end 262. Further, and as best seen by reference to FIG. 4, a pair of ears extend generally longitudinally outwardly relative to the first end 261 and thereby define a channel 264 therebetween. A pair of substantially coaxially aligned apertures 265 are individually formed in each of the ears 263 and are operable to receive a suitable pin or other fastener 266. The drive arm 260 further includes an aperture 270 which is disposed substantially intermediate the first and second ends thereof and which is operable to receive a pin or other fastener 271. As best understood by a study of FIG. 3, the pin or fastener 271 is received in the bore 255, which was discussed, above. As best illustrated by reference to FIG. 4, the second end 262 of the drive arm, mounts a post, or actuator 272 which extends generally normally outwardly relative thereto and which is slideably received in the elongated aperture 256. It should be understood that in an operation, the post or actuator 272 moves in a reciprocal fashion in the elongated aperture 256. This reciprocal motion causes a corresponding rotation of the drive arm about the fastener 271 and a resulting reciprocal movement of the first end 261. This is best imagined by a study of FIG. 2.

As seen in FIG. 2, the apparatus 10 of the subject invention includes a drive bar 280 which is slideably borne on the housing 130 and which is positioned in the first horizontal component 251 of the drive cavity 250. As best illustrated by reference to FIG. 4, the drive bar has a first or proximal end 281 and a second or distal end 282. Further, the drive bar has an angulated intermediate portion 283; and inside facing and outside facing surfaces 284 and 285, respectively. An aperture 290 is formed in the first end 281 and is operable to be coaxially aligned with the aperture 265 to receive the pin 266 and thereby be connected in driving relation relative to the first end 261 of the drive arm 260. Further, the angulated intermediate portion 283 includes a rearwardly facing surface 291. The second end 282 of the drive bar has formed therein a pair of threaded apertures 292 which are operable to matingly receive threaded fasteners 293. As best illustrated by references to FIGS. 3 and 4, the inside surface 284 of the drive bar has at least one tooth 294 which extends generally inwardly relative thereto. The operation of the tooth will be discussed in further detail hereinafter.

A releasable brake 300 is borne by the right half 132 of the housing 130 and is mounted in the first horizontal component 251 of the drive cavity 250. As best illustrated by reference to FIGS. 1, 3 and 4, respectively, the releasable brake 300 is generally L-shaped in its overall configuration and has a first end 301 and an opposite, second end 302. As illustrated most clearly by reference to FIG. 3, a pair of elongated, and narrowly cylindrical shaped apertures 303 are formed in the first end 301 and are operable to receive the fasteners 293 which were discussed above. It should be understood that the pair of elongated apertures 303 are generally coaxially aligned with the pair of threaded apertures 292. The fasteners 293 are received through the cylindrically shaped apertures 303. Further, and before threadably engaging the threaded apertures 292, a pair of biasing springs 304 are received about each of the fasteners. It should be understood that the individual biasing springs urge the releasable brake generally laterally outwardly relative to the drive bar 280. In addition to the foregoing, a pair of smooth bores 305 are formed in the second end 302 and are operable to individually receive threaded fasteners 305. The threaded fasteners 305 are each received in threaded apertures which are formed in the housing 130, and which are not shown. It should be understood that a pair of biasing springs 306 are individually received about each of the individual fasteners before being inserted into the smooth bore. As noted above, the threaded fasteners each extend through the smooth bores and threadably engage the threaded aperture formed in the housing 130. As best seen in FIG. 4, the second end 302 includes a engagement portion 310 which extends normally inwardly therefrom. The engagement portion includes at least one tooth 311. The operation of the brake will be described hereinafter.

As best seen by reference to FIG. 4, the apparatus 10 has a brake release assembly 320. The brake release assembly includes a shaft 321 which has proximal and distal ends 322, and 323, respectively. Further, a handle 324 is fastened to the proximal end thereof. Mounted on the distal end 323 is a generally arcuately shaped camming surface 325. As illustrated, the brake release assembly 320 is operable for rotational movement along a path of travel 326 to release the brake 300. In particular, and upon rotation, the camming surface 325 engages the releasable brake 300 in a fashion whereby it urges the releasable brake and the associated drive bar 280, generally laterally, outwardly, relative to the housing 130 and the drive cavity 250. When this occurs, the brake is released. The shaft 321 of the brake is received in the bore 229, as earlier described.

Working in combination with the releasable brake 300 and the brake release assembly 320, is a brake release actuator 330. The actuator 330 includes a generally cylindrically shaped shaft 331 which is received in the bore 253, and which was described above. The shaft has a proximal end 332 and a distal end 333. As best understood by a study of FIG. 3, a threaded channel 334 is formed in the distal end thereof and which is operable to threadably receive the fastener 114, which was described earlier. It should be understood that the threaded fastener 114 is received in the aperture 113 and thereby secures the second member 110 of the linkage assembly 100 in a fixed position on the distal end of the shaft. Further, and attached to the proximal end 332, is an actuator member 335 and which, when rotated, engages the handle 324 of the brake release assembly. In operation, and as the apparatus 10 engages a work surface 35, the drill 11 continues to move towards the work surface 35. As described earlier, this movement causes a corresponding movement of the linkage assembly 100, and more particularly the first member 101 thereof. This movement of the first member 101 forces the second member 110 forwardly of the housing 130. As this movement of the second member occurs, rotational movement is imparted to the shaft 331 thereby imparting motion to the actuator member 335. As best seen by reference to FIG. 2, the actuator member remains disengaged from the handle 324 thereby permitting the camming surface 325 to remain disengaged from the brake 300, as discussed above. However, and when the apparatus 10 is removed from the working surface, the return spring 94 urges the housing 130 forwardly relative to the drill 11. When this event occurs, the actuator member 335 rotates into engagement with the handle 324 thereby causing the camming surface 325 to release the brake 300, as discussed earlier. The apparatus 10 therefore provides an automatic means for engaging and disengaging the brake 300 of the present device.

Referring more particularly now to a study of FIGS. 3, 7, 11, 15, 19, 21 and 23, respectively, it should be understood that the inside facing surface 226 of the m in body 220 of the left half 131 of the housing 130 defines a plurality of cavities which are operable to enclose and support for movement a multiplicity of assemblies which will be discussed in greater detail hereinafter. As earlier discussed, the left half of the housing, and more particularly, the internal cavities thereof are substantially identical to the right half of the housing, except as will hereinafter be specifically noted, and therefore for purposes of brevity, only the cavities shown in the left half of the housing will be discussed. The plurality of cavities include, generally speaking, a screw track cavity 351, a slide assembly cavity 352, a forwardly disposed indexing cavity 353, a spindle cavity 354 and a release assembly cavity 355. The particular details of each of these cavities are discussed below.

As best seen by reference to FIG. 3, the screw track cavity is defined by the relationship of several surfaces which have been described earlier. Additionally, the screw track cavity includes a bottom supporting surface 360 upon which the individual heads 32 of the screws 31 rest. This is best seen by reference to FIG. 7. The cavity is further defined by the peripheral edge 152 of the main body 150 as well as the peripheral edge 173 of the main body 170. As best seen by reference to FIG. 1 and when assembled, the left and right halves of the housing and more particularly the peripheral edges 152 and 173 thereof are positioned in spaced relation one to the other thereby defining a gap 361 through which the screw belt is received and channeled. The gap defines the path of travel 140 which was discussed earlier. The screw track cavity is coextensive with the path of travel 140 and which extends from the first end of the path 141 to the second end 142. As can best be appreciated by a study of FIGS. 1 and 7, respectively, the screw track cavity has the general shape of the housing 130. Furthermore, it should be understood that the bottom supporting surface 360 is not substantially continuous, that is, it does not extend entirely across the cavity. Rather, and as is best seen by reference to FIGS. 7 and 8, respectively, the forward portion 362 of the cavity is not continuous but rather includes two discreet supporting surfaces 363 which define a gap 364 therebetween. The gap 364 permits an indexing assembly to extend therethrough. The detailed operation of the indexing assembly will be discussed hereinafter.

Figure 7:
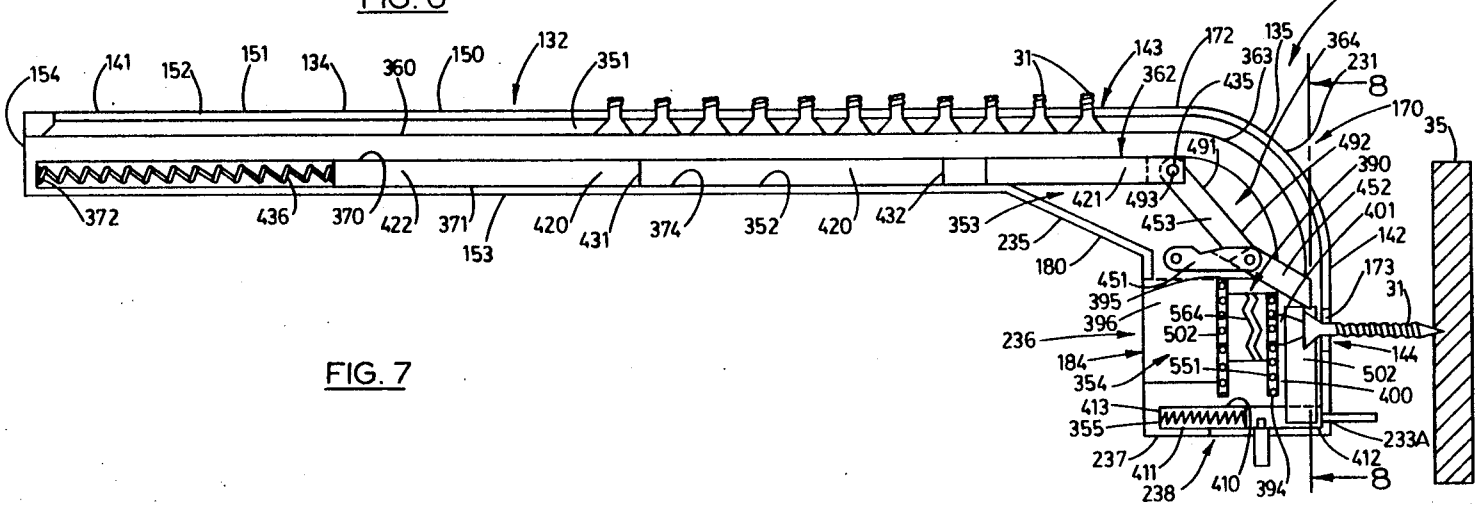
FIG. 7 is a fragmentary, internal, longitudinal, vertical sectional view of the apparatus of the subject invention.
Figure 16:
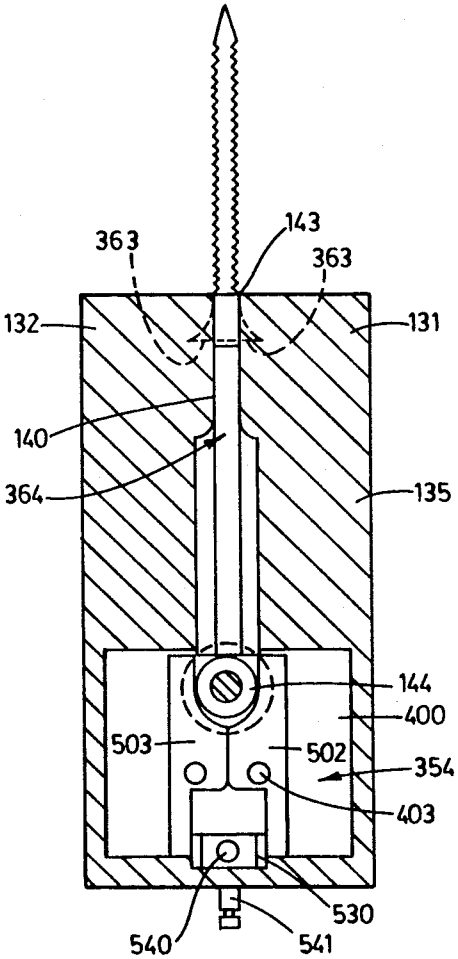
FIG. 16 is a fragmentary, transverse, vertical sectional view of the apparatus of the subject invention and taken from a position along line 16—16 of FIG. 15.
Figure 12:
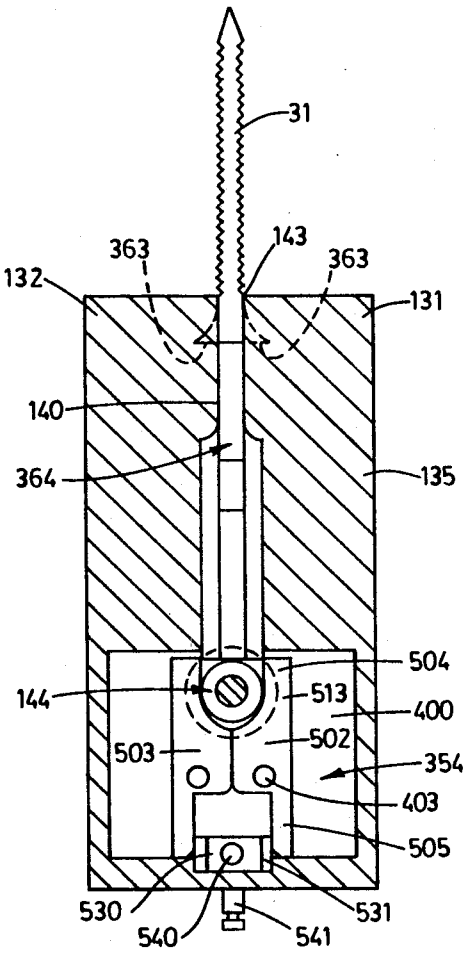
FIG. 12 is a fragmentary, transverse, vertical sectional view of the apparatus of the subject invention and taken from a position along line 12—12 of FIG. 11.
Figure 8:
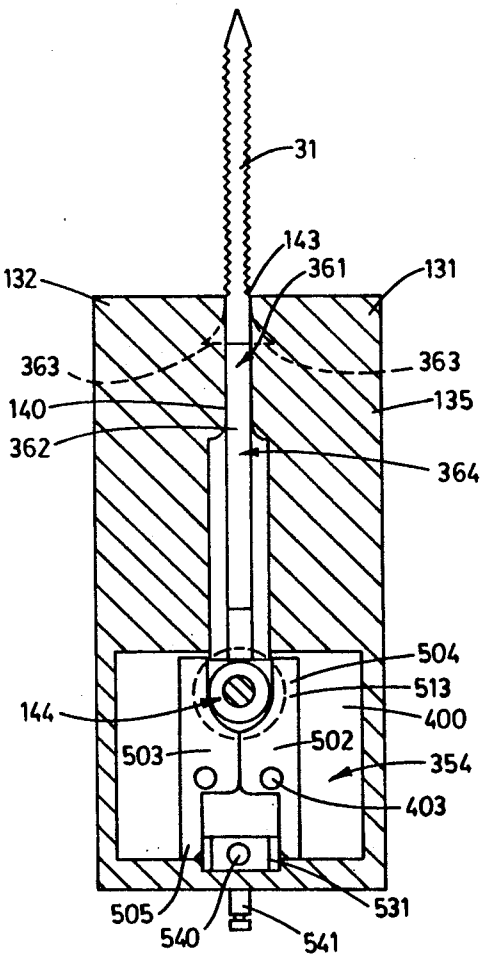
FIG. 8 is a fragmentary, transverse, vertical sectional view of the apparatus of the subject invention and taken from a position along line 8—8 of FIG. 7.
Figure 9:
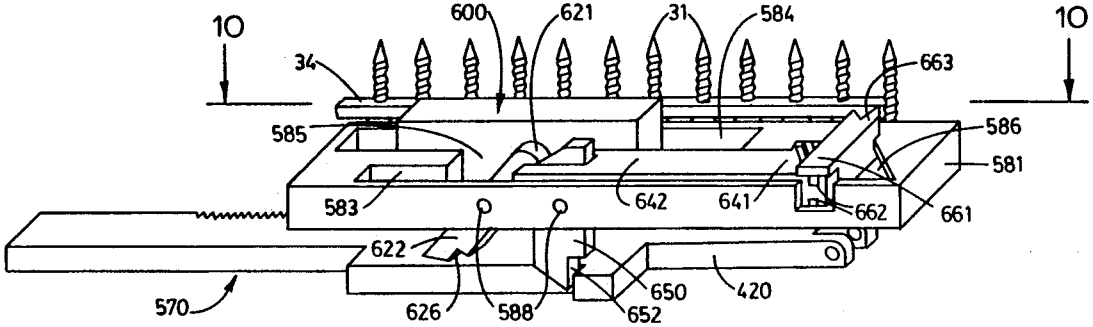
FIG. 9 is a partial, perspective, side elevation view of the apparatus of the subject invention, with supporting surfaces removed, and showing the screw belt severing assembly, and slide assembly, respectively.
Figure 10:
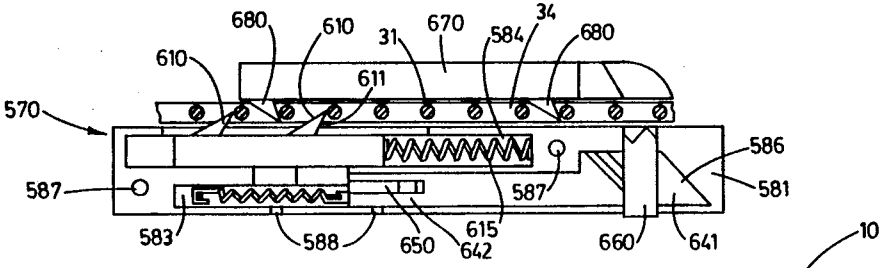
FIG. 10 is a fragmentary, plan, horizontal sectional view of the screw belt severing assembly, and which is taken from a position along line 10—10 of FIG. 9.
Figure 11:
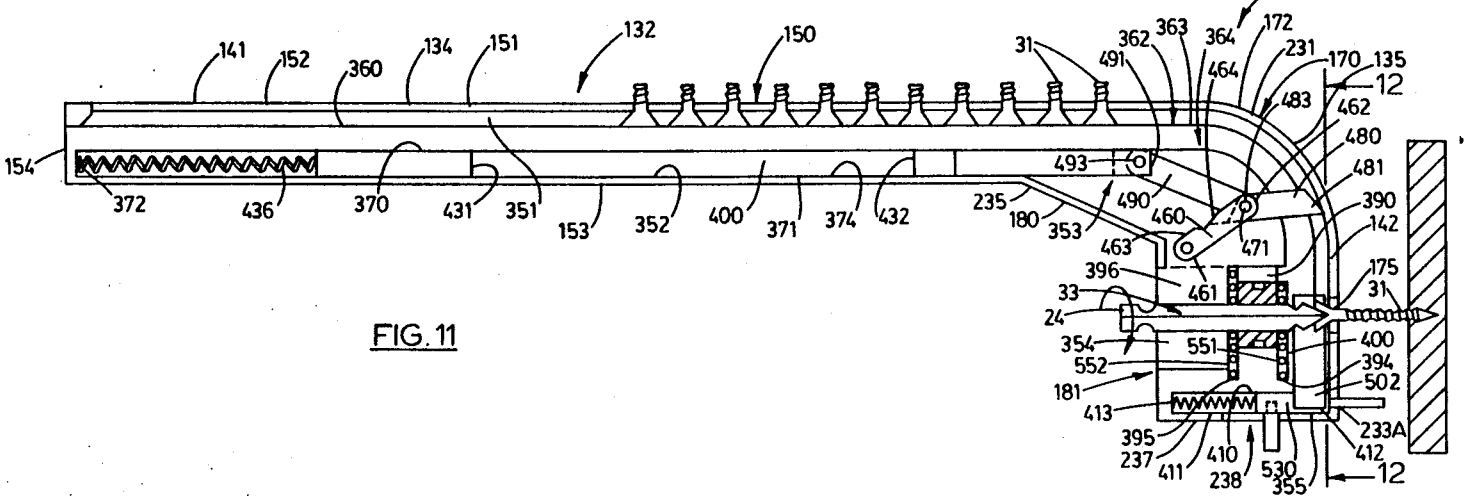
FIG. 11 is a fragmentary, internal, longitudinal vertical sectional view of the apparatus of the subject invention.
Figure 13:
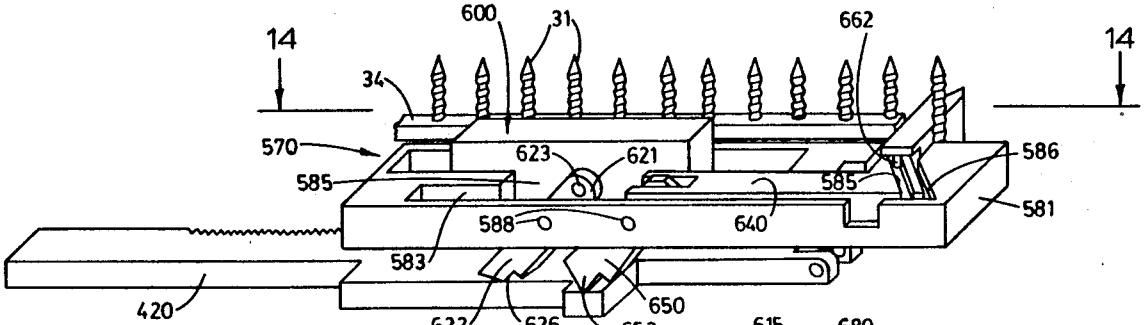
FIG. 13 is a partial, perspective, side elevation view of the apparatus of the subject invention, with supporting surfaces removed, and showing the screw belt severing assembly, and slide assembly, respectively.
Figure 14:
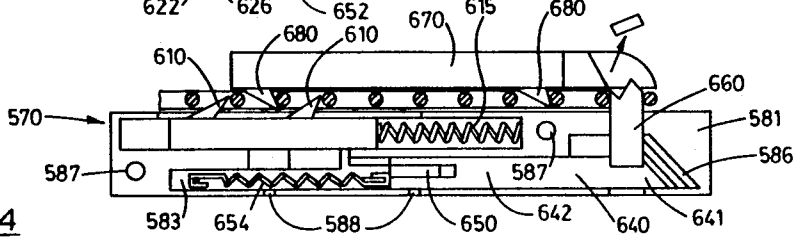
FIG. 14 is a fragmentary, plan, horizontal sectional view of the screw belt severing assembly and which is taken from a position along line 14—14 of FIG. 13.

Referring more particularly to FIGS. 3 and 7, respectively, the slide assembly cavity 352 is defined by a top surface 370; a bottom surface 371; and an end wall 372. Further, and as best seen by FIG. 3, the slide assembly cavity has several component elements. More particularly, the slide assembly cavity has a longitudinal component 374 which is disposed substantially along the longitudinal axis of the housing 130 and is further disposed in communication with the indexing cavity 353. Moreover, and positioned substantially intermediate the longitudinal component, the slide assembly cavity has first and second transversely disposed passageways 375 and 376, respectively, and which extend through the housing and which communicate with the drive cavity 250 which was discussed above. It should be understood that these two intermediate passageways are absent from the cavity defined by the right half 132 of the housing 130. Rather, the right half 132 of housing 130 has one intermediate and transversely disposed passageway, (not shown) which communicates with the indexing cavity 190. As can best be imagined by a study of FIG. 3, and 4, the first and second passageways 375 and 376 permit the teeth 311, and 294, respectively, and which are made integral with the releasable brake 300 and the drive bar 280, to extend into the slide assembly cavity so that they may mechanically engage the slide bar which will hereinafter be discussed in further detail.

As best seen in FIG. 7, for example, the indexing cavity 353 is positioned in a location forward of the slide assembly cavity 352 and is further disposed in communication therewith. The indexing cavity is defined by the inside facing surfaces 158, and 226 of the left and right halves 131, and 132 of the housing 130, as well as the inside facing portions of the rear surfaces 180, and 235 of the housing 130. Moreover, the indexing cavity is disposed in communication with the screw track cavity 351 in the vicinity of the forward portion 362 thereof. The indexing assembly, which is enclosed within the indexing cavity, and which will hereinafter be described in further detail, extends through the gap 364 and into the screw track cavity 351.

The spindle cavity, and which was generally indicated by the numeral 354, is defined by a spindle support structure, and which is generally indicated by the numeral 390. The spindle support structure has opposite first and second ends 391 and 392, respectively, and is further defined by a substantially arcuately or semi-circular shaped surface 393. As best seen in FIG. 3, the elongated and cylindrically shaped aperture 256 extends through the semicircular surface thereby establishing communication between the drive bar 280 and the spindle cavity. The spindle support structure further includes a forward thrust washer recess 394 and a rearwardly disposed thrust washer recess 395. Further, and as best seen by reference to FIG. 3, a cavity 396 is formed in the housing 130 and is operable to accommodate the chuck 22 of the drill 11. The spindle support structure 390 is further defined by a forwardly disposed supporting surface 400 and which is positioned in predetermined space relation relative to the forward surface 231 of the main body 230 and the spindle support structure. The supporting surface 400 has formed therein a semi-circular shaped aperture 401 of predetermined dimensions and which is operable to accommodate the bit 23. Further, a bore 402 is formed in the forward supporting surface and is disposed in substantially coaxial alignment with the bore 234. A pin 403 is adapted to be slideably received in the bores 234 and 402, respectively. The pin mounts a coil spring 404, the significance of which will be discussed hereinafter. Further, it should be understood that a bore (not shown) is formed in the spindle support structure and is disposed in coaxial alignment with the bore 402. This bore also receives the pin 403.

The release assembly cavity, and which is generally indicated by the numeral 355, is defined by top and bottom surfaces 410 and 411 and front and rear walls 412 and 413, respectively. The release assembly cavity is generally narrowly rectangular in shape, and further is disposed in communication with the elongated, generally narrowly rectangular shaped aperture 238 which is formed in the bottom surface 237. This is seen most clearly by reference to FIG. 3. In addition to the foregoing, the release assembly cavity is disposed in communication with the outside environment by mean of the semi-circular shaped aperture 233A which is formed in the forward surface 231 of the main body 230. The relationship of this cavity to the operation of the present apparatus 10 will be described hereinafter.

As best depicted by a study of FIGS. 1 and 4, a slide assembly 420 is defined by a main body having a first end 421 and an opposite second end 422. The slide assembly has a thickness dimension which is generally less than the height dimension of the slide assembly cavity 352. Therefore, it should be understood that the slide assembly 420 is rendered operable for slideable reciprocal movement within the slide assembly cavity. The slide assembly 420 is best seen by reference to FIG. 4, and includes a left peripheral edge 423 and an opposite, right peripheral edge 424. A rack 425 is formed in a predetermined position along the left peripheral edge 423. The rack, which is defined by a plurality of teeth 426, is operable to be engaged by the teeth 311 and 294, respectively, and which are made integral with the releasable brake 300 and drive arm 260. In operation, the individual teeth engage the rack in a fashion whereby the reciprocal motion of the drive bar 280 has the resulting effect of urging the slide assembly 420 rearwardly of the housing 130. In particular, the releasable brake 300 is operable to secure the slide assembly against forward motion until it is released by the brake release assembly 320. A more comprehensive discussion regarding the reciprocal motion of the drive bar 28 will be set forth in the paragraphs which follow. As discussed above, the right peripheral edge 424 includes or otherwise defines a plurality of engagement surfaces 430 and which include a first engagement surface 431 and a second engagement surface 432. Further, and formed on the first end 421 is a pair of ears 433 which extend generally longitudinally outwardly therefrom and which have formed therein a pair of coaxially aligned apertures 434. A pin 435 is operable to be received in the coaxial aligned apertures 434. As best seen by reference to FIG. 7, a biasing spring 436 is received in the slide assembly cavity 352 and is disposed in rested relation against the end wall 372. When compressed, the biasing spring 436 imparts force to the slide assembly 420 thereby urging the slide assembly forward of the housing 130.

Figure 15:
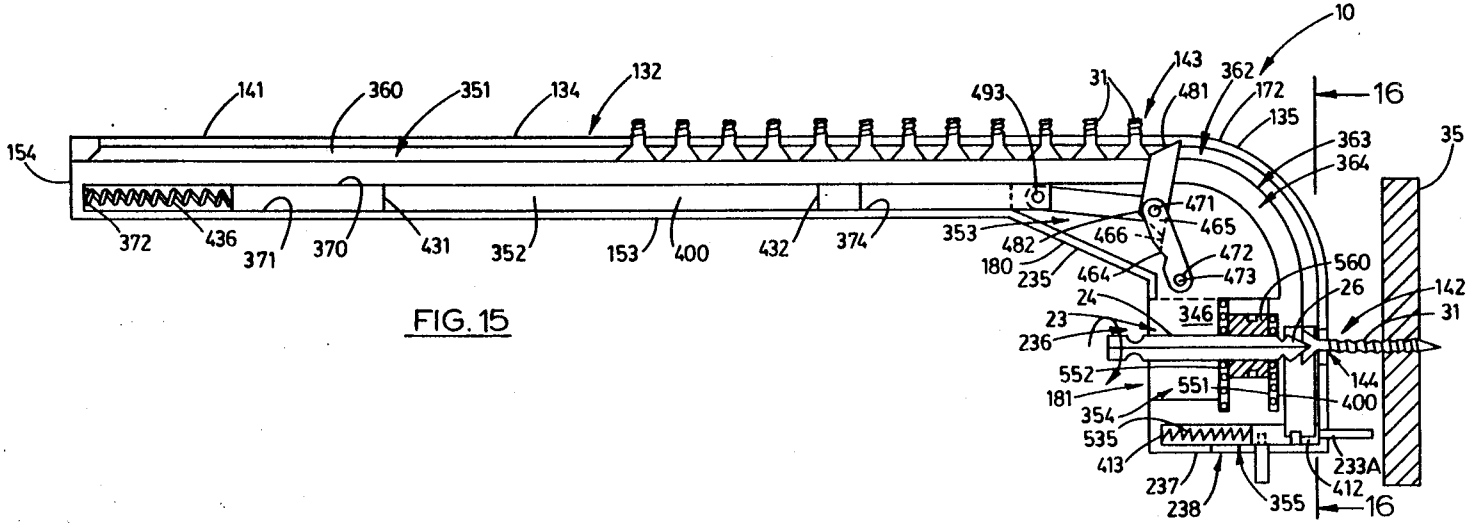
FIG. 15 is a fragmentary, internal, longitudinal, vertical sectional view of the apparatus of the subject invention.
Figure 17:
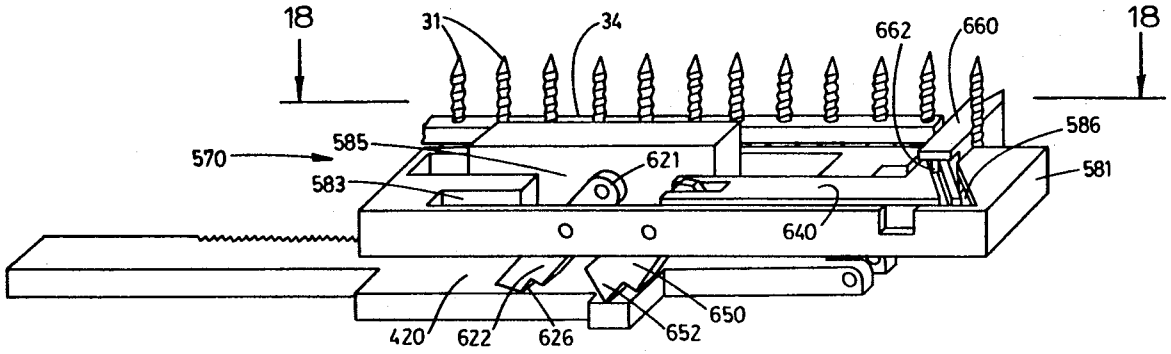
FIG. 17 is a partial, perspective, side elevation view of the apparatus of the subject invention, with supporting surfaces removed, and showing the screw belt severing assembly and slide assembly, respectively.
Figure 18:
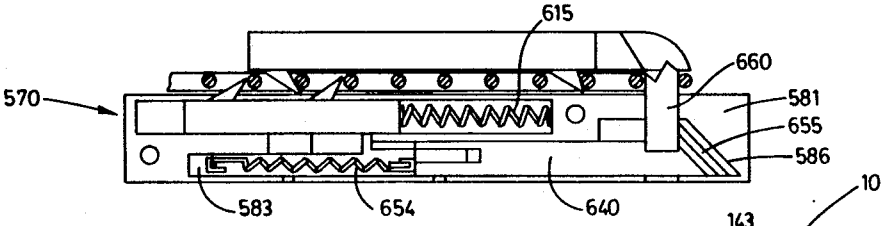
FIG. 18 is a fragmentary, plan, horizontal sectional view of the screw belt severing assembly, and which is taken from a position along line 18—18 of FIG. 17.
Figure 19:
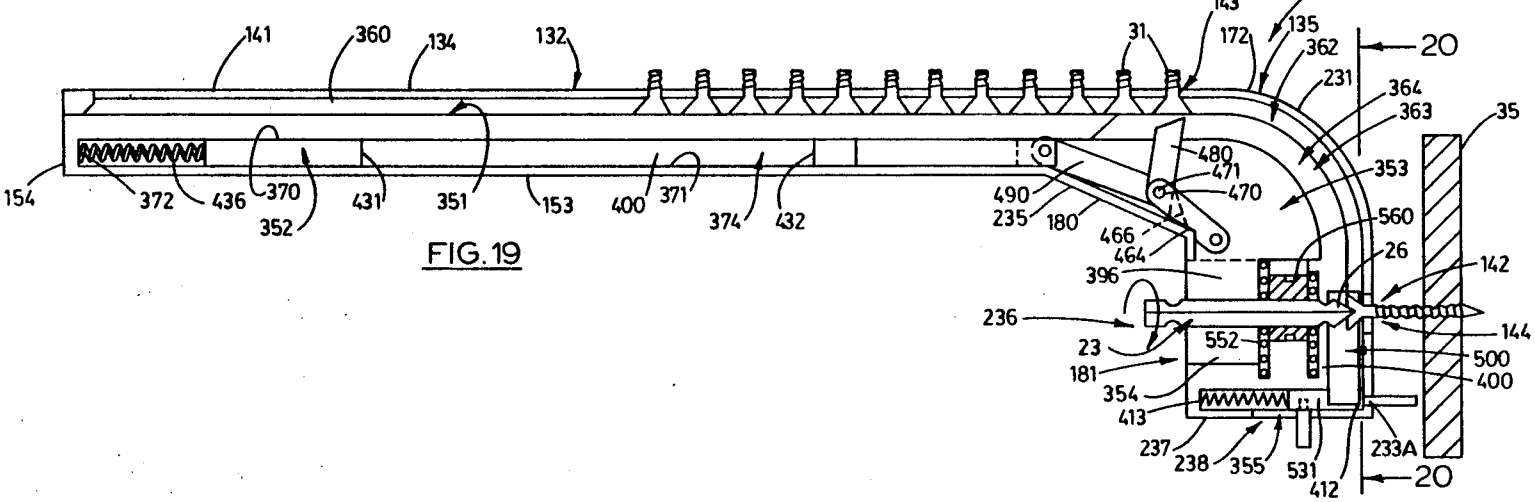
FIG. 19 is a fragmentary, internal, longitudinal, vertical sectional view of the apparatus of the subject invention.

A screw engagement or indexing assembly is generally indicated by the numeral 450 and is best illustrated by reference to FIG. 3, 7, 11, 15, 19, 21 and 23, respectively. The screw engagement or indexing assembly 450 has three major components including a first member 451, a second, index or bar member 452 and a third member 453. As best understood by the sequential views of FIGS. 7, 11, 15, 19, 21 and 23, and which show the indexing assembly during the operational phases of the apparatus 10, the first member has a main body 460 having a first end 461, and an opposite second end 462. Further, and as best seen in FIGS. 7 and 15, for example, the first member has a rearward facing peripheral edge 463 which has formed therein a notch 464. The operation of the notch is best understood by a study of FIG. 19, wherein it engages the rear surfaces 180, and 235, respectively. In addition to the foregoing, the first member has a pair of ears 465 which extend generally longitudinally outwardly relative to the first end 461. A rearwardly facing, and sloped surface 466 is positioned in the space which is defined by the ears 465. This is shown in hidden lines in FIG. 15, for example. A pair of substantially coaxial aligned apertures 470 are formed in each of the ears 465 and are operable to frictionally receive a pin or shaft 471. Further, a coil spring, not shown, is operable to be received about the pin 471 and is operable to engage the second member 452 and the first member 451. As should be understood, the spring is operable to urge the index member 452 into engagement with the sloped, rearwardly facing surface 466. A bore 472 is formed in the second end 462 of the main body and is operable to receive a pin 473. The pin 473 is further received in the bore 254, the pin operating as an axis of rotation for the first member 451.

The second, or indexing member 452 has a main body 480 which has a first end 481 and an opposite second end 482. Further, an aperture 483 is formed in the second end thereof. It should be understood that the aperture 483 is substantially coaxially aligned with the pair of coaxially aligned apertures 470 which are formed in the ears 465. Further, the pin 471 is received through the aperture 483. Moreover, and as discussed above, it should be understood that the spring, which is not shown, engages the second end 482 of the second member thereby urging it toward the sloped rearwardly facing surface 466.

The third member 453 has a main body 490 which has a first end 491 and an opposite second end 492. A pair of apertures 493 are individually formed in the first and second ends thereof. The aperture 493 which is formed in the first end is positioned between the ears 433 of the slide assembly 420 and the pin 435 extends therethrough. Further, the aperture 493, at the second end 492, is further substantially coaxially aligned with the pair of apertures 470, and the pin 471 is received therethrough.

As should be understood by a study of the sequential drawings of FIGS. 7, 11, 15, 19, 21 and 23, as the slide assembly 420 is urged rearwardly of the housing 130 by the reciprocal movement of the drive bar 280 and is thereafter restrained from moving forward by the action of the releasable brake 300, the screw engagement or indexing assembly 450 is pulled rearwardly of the housing 130. As this rearward motion continues, the second member 452 is urged along a path of travel rearwardly and slightly below a screw 31, which is positioned in the first, ready position 143. Further, and when the releasable brake 300 is activated, the slide assembly, under the influence of the biasing spring 436 moves forward relative to the housing 130. When this event occurs, the second or index member 452 is urged generally forwardly and then upwardly thereby extending up through the gap 364 which is defined between the supporting surfaces 363 of screw track cavity 351. When this event occurs, and as the forward motion of the slide assembly 420 continues, the index bar, and more particularly the first end 481, thereof, urges the screw which is in the ready position along the path of travel 140 to the second, driving position 144.

Figure 22:
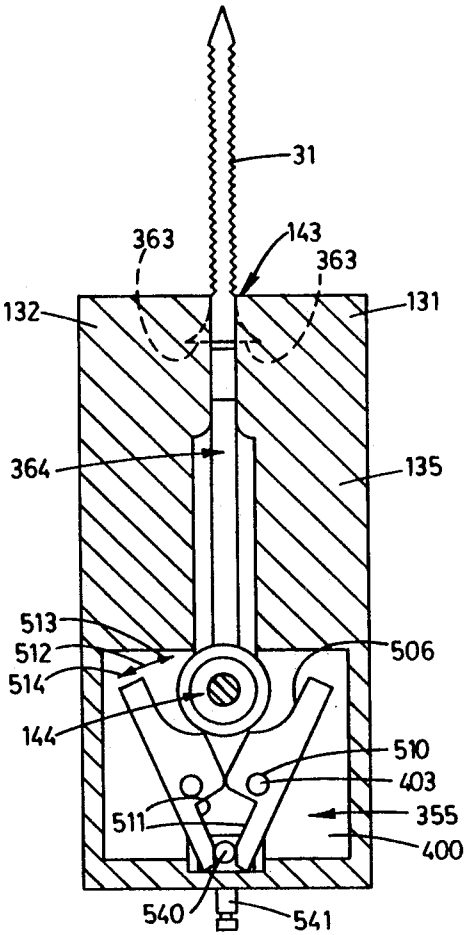
FIG. 22 is a fragmentary, transverse, vertical sectional view of the apparatus of the subject invention and taken from a position along line 22—22 of FIG. 21.
Figure 20:
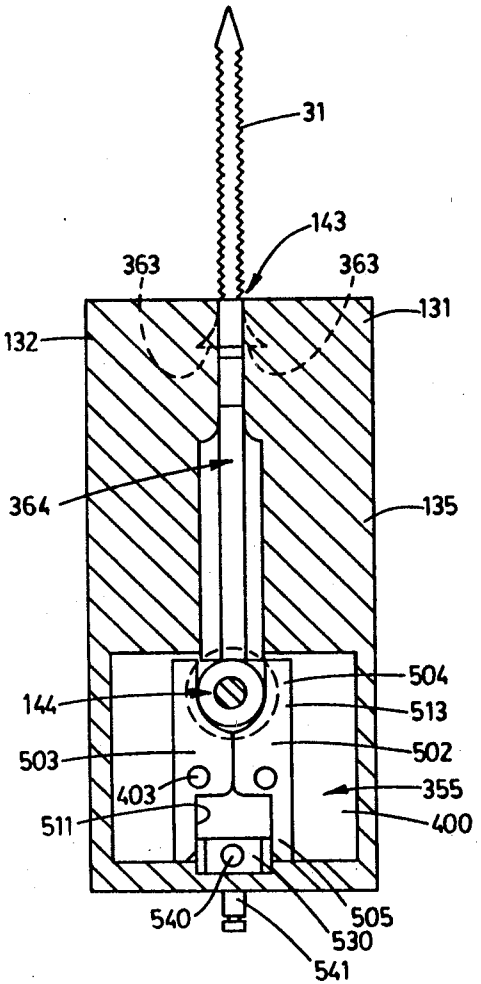
FIG. 20 is a fragmentary, transverse, vertical sectional view of the apparatus of the subject invention and taken from a position along line 20—20 of FIG. 19.
Figure 21:
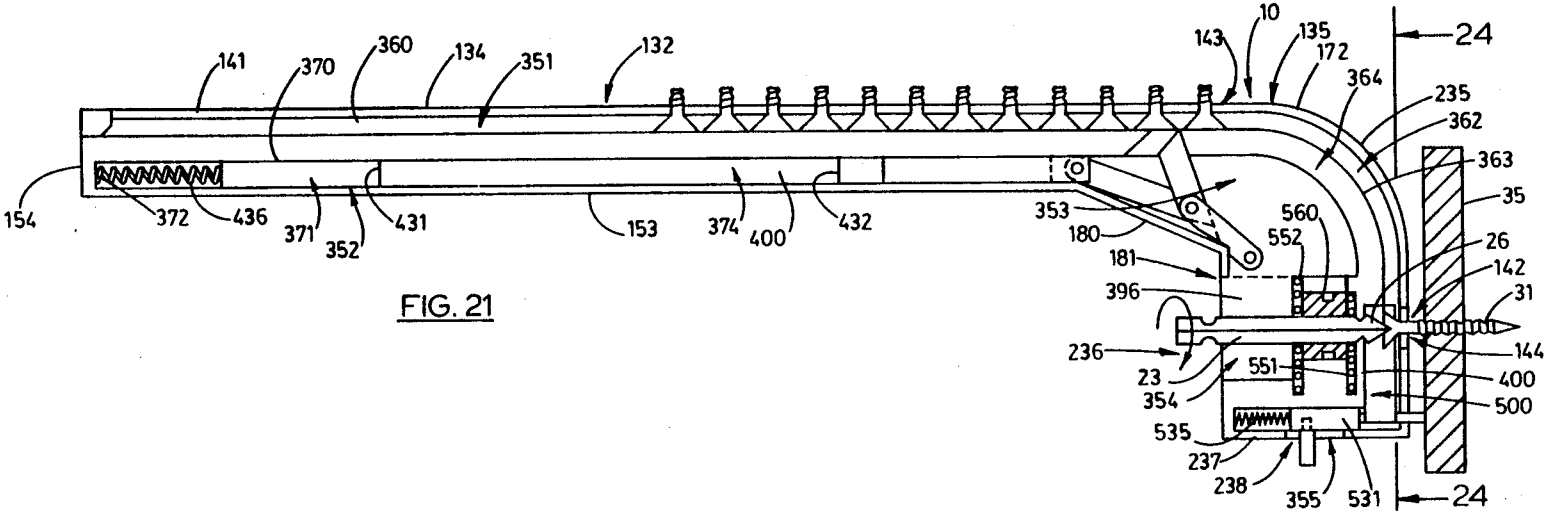
FIG. 21 is a fragmentary, internal, longitudinal, vertical sectional view of the apparatus of the subject invention.
Figure 23:
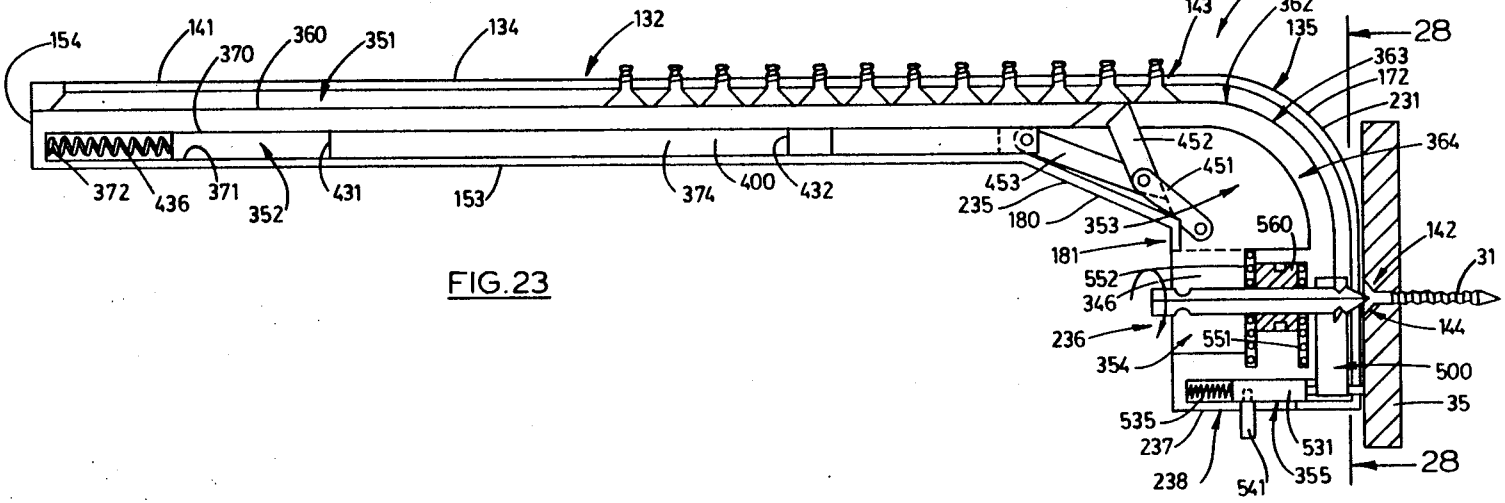
FIG. 23 is a fragmentary, internal, longitudinal, vertical sectional view of the apparatus of the subject invention.

As best understood by a study of FIGS. 3, 20 and 22 respectively, the apparatus 10 of the subject invention defines a screw engagement station which is generally indicated by the numeral 500, and which is disposed at the distal end of the screw track cavity 351. The screw engagement station 500 is defined by a positioning assembly which includes two screw positioning arms 501. These arms 501 include a left arm 502 and an opposed right arm 503. The individual arms 502 and 503 each have opposite first and second ends 504 and 505, respectively. As best seen by reference to FIG. 20, for example, the individual arms have inwardly facing screw engagement surfaces 505 and 506, respectively, and which are operable to cradle and orient the individual screws in a predetermined attitude such that they extend generally longitudinally outwardly relative to the housing 130, and further can be engaged by the bit 23.

Figure 24:
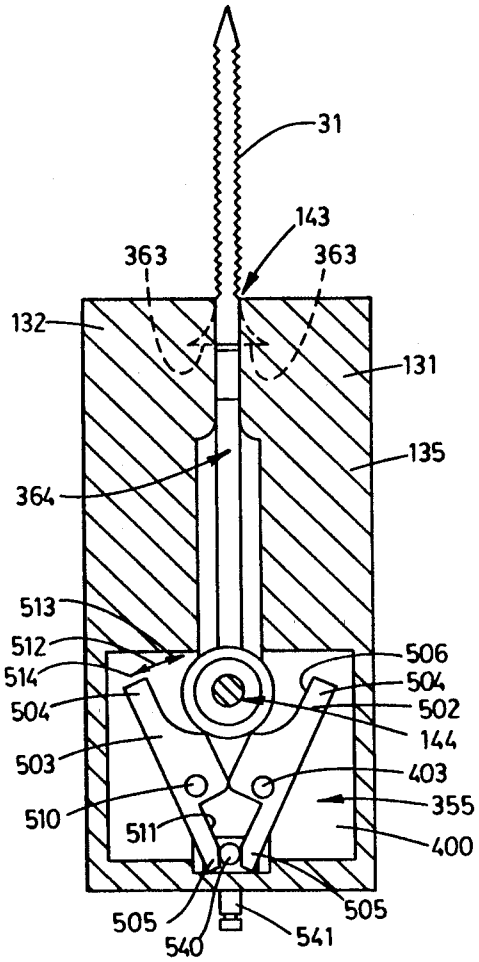
FIG. 24 is a fragmentary, transverse, vertical, sectional view of the apparatus of the subject invention, and which is taken from a position along line 24—24 of FIG. 23.

Further, individual apertures 510 are formed in the second end 505 of each of the arms. The apertures are adapted to receive the pins 403, which were discussed above. The pins 403 render the individual arms rotatable. As earlier discussed, coil springs 404 are individually received about each of the pins 403 and are operable to act upon the individual arms thereby urging them along individual paths of movement 512 from a first, or locking position 513 wherein the arms are disposed in opposition, one to the other, as shown in FIG. 20, to a second, or open position 514 and wherein they are separated and disposed in spaced relation, one to the other. This is best shown by reference to FIG. 24. When disposed in the open position, the screw 31, which is being installed, is released from the screw engagement station 500.

As should be understood, the individual screw positioning arms 501 are maintained in their locked position 513 by a locking assembly and which is generally indicated by the numeral 530. The locking assembly has a generally rectangular shaped main body 531 which is operable for slideable movement within the release assembly cavity 355. The main body includes opposite first and second ends 532 and 533, respectively, and further has a bottom surface 534. The first end has a truncated shape. As best illustrated by reference to FIG. 23, for example, the biasing spring 535 is biased between the second end 533 and the rear wall 13 of the release assembly cavity 355. The biasing spring is operable to urge the main body 531 towards the front wall 412 of the release assembly cavity and into impeding relation relative to the lower locking surfaces 511 thereby impeding rotation of the individual screw positioning arms 501 about each of the pins 403. As earlier discussed, the screw positioning arms are individually operable, under the influence of each of the springs 404 to move generally from the locked position 513 to the open position 514. As best illustrated by reference to FIG. 7, for example, the main body 531 of the locking assembly includes a first post 540 which extends generally longitudinally outwardly therefrom and through the semicircular aperture 233A. Further, a second post 531 is mounted on the bottom surface 534 and extends through the elongated, narrowly rectangular shaped aperture 238. This second post can be engaged by an artisan's hand, for example, in the event that the artisan wishes to release a screw 31 from the screw engagement station 500 as when, perhaps, the apparatus 10 is employed to remove a screw from a work surface 35. Moreover, it should be understood that the first post 540 is operable to engage the work surface 35 as the housing 130 advances towards the work surface. In operation, and as the first post comes into contact with the work surface, it urges the main body 531 rearwardly of the housing 130 and clear of the lower locking surfaces 511, thereby permitting the individual springs 404 to rotate the respective left and right arms 502 and 503 along the individual paths of movement 512 from the locked position 513, to the open position 514, thereby releasing the screw 31. In this fashion, the screw to be installed is released at an appropriate time from the screw engagement station 500 once it has achieved sufficient penetration of the work surface 35. This is best appreciated by studies of FIGS. 7, 11, 15, 19, 21 and 23, respectively.

As best illustrated by reference to FIG. 3 and 4, respectively, thrust washers 550, and which include a first or forwardly disposed thrust washer 551 and a second or rearwardly disposed thrust washer 552 are slideably received in fitted relation in the thrust washer recesses 394 and 395, respectively. The thrust washers are substantially rectangular in their overall configuration and have a substantially centrally disposed aperture 553 which has a diametral dimension which is greater than the cross sectional dimensions of the bit 23. Further, the individual thrust washers include a pair of pin apertures 554 and which, when positioned in the individual thrust washer recesses, are disposed in substantially coaxial alignment to receive the individual pins 403.

As best understood by a study of FIG. 4, a spindle or bit engagement member 560 is received in the spindle support structure 390 and more particularly is supported for rotational movement on the arcuately or semicircular shaped surface 393. The spindle 560 is generally circular in its overall configuration. However, the main body 561 of the spindle has a substantially centrally disposed and hexagonally shaped aperture 562 which has a cross-sectional dimension which is just slightly greater than the cross-sectional dimensions of the bit 23. As should be understood, and when the bit is advanced to engage a screw 31, which is located in the screw engagement station 500, the bit is received in the spindle 560 and thereby engages same thus imparting rotational movement to the spindle. The spindle 560 has an exterior facing surface 563 which has an undulating channel 564 formed therein. As should be understood, and when disposed in the spindle support structure 390, the post or actuator 272 of the drive arm 260 is received in the undulating channel. In operation, and as rotational movement is imparted to the spindle by means of the bit 23, the drive arm 260 is caused to rotate in a reciprocal fashion about the pin 271, and which is received in the intermediate aperture 270. This reciprocal motion is thereafter imparted to the drive bar 280 thereby reciprocating the drive bar in the drive cavity 250. This reciprocal motion of the drive bar, as earlier discussed, is operable to cause the tooth 294 to engage the rack 425 of the slide assembly 420 thereby urging the slide assembly rearwardly of the housing 130. Further, and as was discussed earlier, the releasable brake 300 is operable by means of the tooth 311 to impede the movement of the slide assembly 420 in a direction forward of the housing 13 under the influence of the compression spring 436. In operation, and as the housing 130 comes into contact with the work surface 35, the locking assembly 530 is urged rearwardly of the housing 130 and out of contact with the lower locking surfaces 511 of the left and right screw positioning arms 502 and 503, respectively. As this event occurs, the screw 31 is released from the screw engagement station 500. Additionally, and as earlier discussed, the movement of the drill 11 towards the work piece 35 has the additional effect of causing the linkage assembly 100 to operate, in combination with, the brake release actuator 330, thereby causing the actuator member 335 to remain disengaged from the brake release assembly 320. Therefore, and as the artisan removes the apparatus 10 from the work surface 35, it should be understood that the brake release assembly is subsequently engaged by the brake release actuator in a fashion whereby the slide assembly 420 is released from its rearward restrained position, and is operable to move forwardly of the housing 130. As earlier discussed, this forward motion causes the screw engagement or indexing assembly 450 to urge a screw 31 from the first, ready position 143 to the second, driving position 144.

As best understood by a study of FIG. 3, and the sequential FIGS. 6, 10, 14 and 18, respectively, the apparatus 10 has a screw belt advancement assembly and which is generally indicated by the numeral 570. The screw belt advancement assembly is enclosed in a housing 580 that is affixed by fasteners 157 to the top surface 151 of the right housing 132. As best illustrated by the exploded view of FIG. 3, and the plan views of, for example, FIGS. 6 and 10, respectively, the housing 580 has a lower portion 581, and an upper portion or cap 582 which encloses same. The lower portion 581 includes a first, generally longitudinally disposed cavity 583, and a second generally longitudinally disposed cavity 584. Further, an intermediate or transverse cavity connects the first and second cavities together. The first, longitudinally disposed cavity 583 includes a forward, or cutter head cavity, and which has dimensions which will accommodate a cutting assembly which will hereinafter be discussed in further detail. As best seen by the exploded view of FIG. 3, a pair of substantially coaxially aligned apertures 587 are formed in the upper and lower portions 581 and 582 and are adapted to accommodate the fasteners 157 which are received therethrough. As should be understood, the fasteners 157 are threadably advanced into the aperture 156 which are formed in the top surface 151. Further, a pair of apertures 588 are formed in the peripheral edge of the housing 580 and are operable to receive individual pins or fasteners 589.

Figure 5:
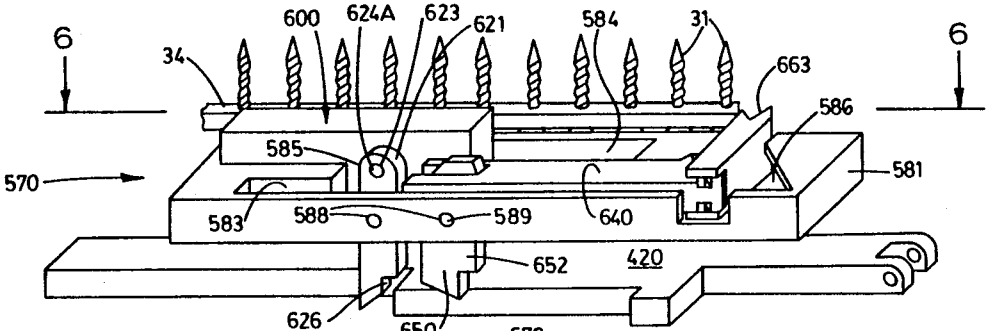
FIG. 5 is a partial, perspective, side elevation view of the apparatus of the subject invention, with supporting surfaces removed, and showing the screw belt severing assembly, and slide assembly, respectively.
Figure 6:
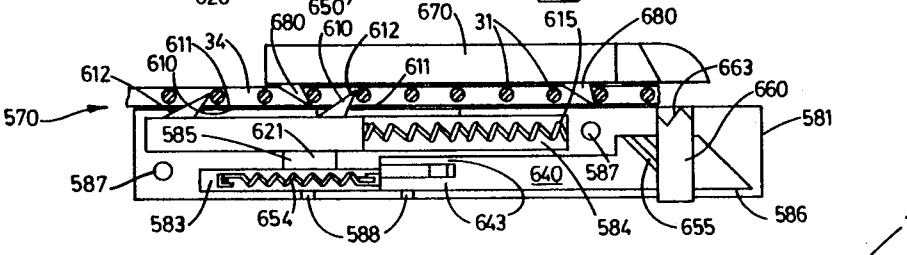
FIG. 6 is a fragmentary, plan, horizontal sectional view of the screw belt severing assembly, and which is taken from a position along line 6—6 of FIG. 5.

As best understood by a study of FIG. 5, for example, and the sequential views of FIGS. 6, 10, 14 and 18, respectively, the screw belt advancement assembly 570 includes a moveable main body 600 which is slideably mounted for substantially reciprocal movement in the second, longitudinally disposed cavity 584. In this regard, the main body is substantially rectangular in its overall configuration and has a first end 601 and an opposite second end 602. Further, the main body has a bottom surface 603 which has formed therein a pair of spaced, and substantially transversely disposed channels, 604. In addition, and formed generally centrally of each of the channels 604 are individual bores, not shown, and which are operable to receive individual pins 605. As best seen by a study of FIG. 3 and 6, for example, the main body 600 mounts a pair of dogs 610. Each of the dogs 610 have a forward engagement surface 611, and an opposed rearwardly facing engagement surface 612. Further, and as illustrated most clearly by reference to FIG. 3, an aperture 613 is formed in each of the dogs and is operable to receive the individual pins 605. Moreover, and received about each of the pins and positioned between each of the dogs 610, and the bottom surface 603, are individual coil springs 614. As should be understood, the individual coil springs are each operable to engage the bottom surface 603, and the individual dogs in such a fashion whereby the dogs are each urged to move in a direction whereby they each extend generally laterally outwardly relative to the housing 580. However, it should be understood that the springs are each operable to permit the dogs to be depressed such that they may slide by the individual screws 31, which are made integral with the belt 34, when the main body 600 is urged rearwardly of the housing 130 by the action of the biasing spring 615.

A spring biased engagement assembly 620 is mounted on the main body 600 and includes two members, that is, a first member 621 and a second member 622 which is rigidly mounted thereto. In particular, the first member 621 has formed therein a pair of apertures 623 which are disposed in the opposite ends thereof, and which are operable to receive pins 589 and 624A, respectively. As should be understood, pin 589 extends through aperture 588 and into aperture 623, and pin 624A extends through the aperture 623 at the opposite end of the first member and into the main body 600. This is shown most clearly by reference to FIG. 3. Additionally, an aperture 625 is formed in one end of the second member 622 and is substantially coaxially aligned with one of the apertures 588 such that it may receive pin 589.

In operation, and as best seen by the sequential views of FIG. 5, 9, 13 and 17, respectively, the motion of the slide assembly 420 rearwardly of the housing 130, by way of the force transmitted thereto by the drive bar 280 has the effect of causing the first engagement surface 431 to come into contact with the spring biased engagement assembly 620. When this event occurs, the first and second members 621 and 622 rotate about the pin 589 and thereby urge the main body 600 in a direction forward of the housing 130 and toward the work surface 35. As this motion occurs, the pair of dogs 610 are operable to engage individual screws 31, which are made integral with the belt 34 and urge the entire screw belt 30 along the path of travel 140 toward the screw engagement station 500. Further, and when the slide assembly 420 is released from its restrained position rearwardly of the housing 130 and is permitted to slide forwardly, the main body 600, under the force of the biasing spring 615 is operable to urge the moveable main body 600 rearwardly of the housing 130. As should be understood, the pair of dogs 610, and more particularly the rear engagement surfaces thereof strike the screws 31 and thereby depress the dogs against the force of the individual springs 614 which maintain the dogs in their generally laterally outwardly disposed position. The dogs thus pass by the screws 31. The moveable main body 600 is therefore operable for generally reciprocal movement once it is engaged by the first engagement surface 431 of the slide assembly 420 and is therefore operable to urge the screw belt 30, one screw at a time, along the path of travel 140 towards the first ready position 143.

As best seen by a comparative study of FIG. 3, in combination with FIGS. 6, 10, 14 and 18, respectively, the apparatus 10 includes a screw belt severing assembly and which is generally indicated by the numeral 640. The severing assembly 640 is enclosed within the housing 580 and is rendered operable for reciprocal movement in the first longitudinally disposed cavity 583. The severing assembly 640 has a first end 641 and an opposite second end 642. Further, and extending generally longitudinally outwardly and in space relation one to the other at the first end 641 thereof, is a pair of ears 643. The ears have formed therein substantially coaxial aligned apertures 644, and which are operable to receive a pin 645 of suitable dimensions. Positioned between the ears 643 is an engagement member 650 which has a proximal end 651, an opposite, distal end 652, which is operable to engage the second engagement surface 432 of the slide assembly 420. The proximal end 651 has an aperture, not shown, and which receives the pin 645 thereby rendering the engagement member 650 rotatable about the pin 645. Further, a bore 653 is formed in a position near the distal end 652. The bore 653 is operable to receive the pin 589. In addition to the foregoing, a return spring 654 is fastened to the first end 641 and is further fastened to the housing 580.

The return spring is operable to provide a force for urging the severing assembly rearwardly of the housing 580. As best seen by reference to FIG. 13, for example, a pair of angulated camming surfaces 655 are formed in the second end 642 of the severing assembly. The angulated camming surfaces are operable to cooperate with a cutter blade 660 in a fashion whereby movement of the severing assembly towards the work surface 35, for example, causes a corresponding movement of the cutter blade along the cutter head cavity 586, and into a position whereby it extends generally laterally outwardly relative to the housing 580 and thereby engages, in cutting relation, the synthetic, polymer-based screw belt 30 thus severing the continuous belt between adjoining or juxtapositioned screws 31. In particular, the cutter blade 660 has a proximal engagement surface 661 which has formed therein a pair of guide pins 662 which are slideably received in the angulated camming surfaces or channel 655, and has an opposite, distal cutting blade 663.

In operation, and when the slide assembly 420 is urged rearwardly of the housing 130 by the action of the drive bar 280, the second engagement surface 432 of the slide assembly 420 strikes the distal end 652 of the engagement member 650 thereby rotating it about the pin 589. This rotation causes a corresponding movement of the severing assembly 640 in a direction generally toward the work surface 35. As this forward movement occurs, the cutter blade 660 is caused to move generally laterally outwardly and into severing engagement with the synthetic screw belt 30 in a fashion whereby it is severed and a section of belt 34 is pushed away thereby freeing an individual screw 31 for movement along the path of travel 140 from the first, ready position 143 to the second driving position 144. This is most clearly illustrated by reference to FIG. 14. It should be understood that upon movement of the slide assembly 420 in a direction forwardly of the housing 130, the severing assembly, under the force of the return spring 654, is urged rearwardly of the housing 130 and the cutter blade 660 is urged internally of the housing 580 and out of engagement with the synthetic screw belt 30.

A retarding mechanism and which is generally indicated by the numeral 670 is surmounted and otherwise borne by the left half 131 of the housing 130 and more particularly the top surface 221 thereof. The retarding mechanism is operable for retarding the movement of the continuous belt 30 of screws 31 in a direction rearwardly of the housing 130 and away from the screw engagement station 500. More particularly, the retarding mechanism includes a housing 671 which has a top surface 672 and an opposite, bottom surface 673. The bottom surface has formed therein a pair of spaced and substantially transversely disposed channels 674. This is best illustrated by reference to FIG. 3. Further, individual bores, not shown, are formed in the bottom surface 673 and are operable to accommodate individual pins 675. As best seen by reference to FIG. 3, and the sequential views of FIGS. 6, 10, 14 and 18, respectively, the housing 671 mounts spring biased dogs 680, and which are individually operable to retard the movement of the continuous belt in a direction away from the screw engagement station 500. In particular, it should be understood that the spring biased dogs 680 are each operable, under the influence of individual coil springs 681 to extend generally laterally outwardly, relative to the housing 671 and into engagement with the individual screws 31 thereby impeding their movement rearwardly of the housing 130. As best illustrated by reference to FIG. 3, a pair of aperture 682 are formed in the top surface of the retarding mechanism 670 and are operable to receive the threaded fasteners 228. The pair of apertures 682 are disposed in a position whereby they are substantially coaxial aligned with the apertures 227 that are formed in the top surface 221 of the left half of the housing. Further, it should be understood that the housing 671 includes a pair of spaced ears 683, and which are operable to receive a pivotable engagement surface 684. The engagement surface 684 has an aperture 685 formed therein and which is operable to receive the threaded fastener 228. In this fashion, the cutter blade 660 is operable to engage the synthetic polymer belt 34 of the continuous belt 30 and press it against the engagement surface 684 thereby cleanly severing same.

OPERATION

The operation of the described embodiment of the present invention is believed to be readily apparent and is briefly summarized at this point.

As best seen by reference to FIGS. 1 and 2, the apparatus 10 for selectively installing a plurality of screw type fasteners 31 and which are combined together into a continuous belt 30, includes a means for imparting rotational movement to the individual screws about their respective longitudinal axis. In this regard, the means for imparting rotational movement includes a conventional drill 11 and which mounts a hexagonally shaped bit 23 which has a forwardly disposed screw engagement surface 26. The apparatus 10 further includes a housing 130 which is borne on the rotation means and which defines path of travel 140 for the individual screws 31. The individual screws travel from a first, ready position 143 to a second, driving position 144. In this regard, the housing 130 has left and right halves 131 and 132, respectively, and which define the path of travel 140. The screws 31, once severed from the substantially continuous belt 30 are operable to individually travel from the first ready position 143 to the second driving position 144 whereby they are subsequently engaged by the bit 23. The apparatus 10 further includes a drive assembly which is borne by the housing 130 and which is reciprocally moveable relative thereto. The drive assembly is engaged by the rotation means. In this regard, the drive assembly includes a drive arm 260 and a drive bar 280 which are disposed in mechanical communication, by way of the post 272, with the spindle or bit engagement member 560. As earlier discussed, and as the spindle rotates in response to the rotational movement of the bit 23, the undulating channel 564 causes the drive arm and the drive bar to reciprocate. This reciprocal motion has the effect of causing the tooth 294, of the drive bar 280, to engage the rack 425 of the slide assembly 420. As earlier discussed, and when this event occurs, the slide assembly 420 is urged rearwardly of the housing 130 and against the force of the biasing spring 436. The slide assembly is secured in this rearward, restrained position, by the releasable brake 300.

The apparatus 10 also includes a screw engagement assembly 450 and which is rotatably borne by the housing 130 and which is mechanically driven, by means of the slide assembly 420, which was discussed above. In operation, the screw engagement assembly 450 is moveable along a path of travel both towards the second driving position 144, and away from the second driving position. When the screw engagement assembly is moved towards the second driving position, it is operable, by way of the second or index member 452, to urge individual severed screws 31 into the second, driving position 144. In addition to the foregoing, the apparatus 10 includes a releasable brake 300, which is borne by the housing 130, and which is operable to releasably engage the drive assembly, and more particularly, the slide assembly 420, as described above, thereby restraining the screw engagement or indexing assembly 450 against motion towards the second driving position 144. When employed, the releasable brake permits movement of the slide assembly 420, and the associated screw engagement assembly towards the second driving position. The apparatus 10 also includes a positioning assembly which has a pair of screw positioning arms 501, and which are borne by the housing 130. The arms 501 are operable to releasably secure the individual screws 31 in the second driving position 144, and more particularly, in the screw engagement station 500. Finally, the apparatus 10 includes a means for releasing the individual screws from the positioning assembly. In this regard, the apparatus 10 includes a locking assembly or lug 530 and which is operable to be moved rearwardly of the housing 130 and out of engagement with the lower locking surfaces 511 of the left and right arms 502 and 503, respectively. When this event occurs, the individual arms 502 and 503 are operable to move along individual paths of movement 512 from a locked position 513 to an open position 514 thereby releasing the screw 31 from the housing 130.

In addition to the foregoing, the apparatus 10 also includes a screw belt advancement assembly 570, which is borne by the housing, and which is operable to engage the screw belt 30. As should be understood, and upon movement of the slide assembly 420 rearwardly of the housing 131, the advancement assembly is caused to engage the screw belt 30 and urge it in a direction of the screw engagement station 500. As earlier discussed, the advancement assembly 570 employs spring biased dogs 610 which are operable to engage the individual screws 31 which are fixed together by the continuous belt 34. A screw belt severing assembly 640 is borne by the housing 130 and is operable for movement into severing engagement relative to the continuous belt 30 when the slide assembly 420 is urged rearwardly of the housing 130 under the influence of the drive bar 280. Moreover, the cutter blade 660 is operable for movement internally of the housing 580 when the slide assembly 420 is urged forwardly of the housing 130. Finally, a retarding mechanism, and which is generally indicated by the numeral 670, is borne by the housing 130 and is operable to retard movement of the screw belt 30 away from the screw engagement station 500.

The apparatus 10 of the subject invention and which is operable for selectively installing a plurality of screw type fasteners 31 which are formed together in a continuous belt 30, provides a novel means and method for installing these same fasteners by providing a device which supports each of the screw fasteners for movement along a predetermined path of travel 140 from a first, ready position 143 to a second, driving position 144, and further, the apparatus 10 urges the continuous belt 30 along the path of travel from the first position towards the second position. The apparatus 10 further is operable to sever the continuous screw belt at locations between juxtaposed screws, and thereafter urges the individual severed screws along the path of travel to the second driving position. Once positioned in the driving position, the apparatus 10 is further rendered operable to secure the individual screws against movement in the second driving position and thereafter imparts screw threadable rotational movement to the individual screws which are secured in the driving station 500. Finally, the apparatus 10 is operable to release the individual screws from the driving station, thereby permitting the threaded shaft of each of the screws to threadably engage an adjacent work surface 35.

Therefore, the apparatus 10 of the subject invention can be employed in a wide variety of operative environments, can be manufactured and purchased at moderate cost when compared with related prior art devices, is highly efficient in operation and is compact, thereby facilitating its utilization and maintenance, and is further designed in a fashion whereby it reduces to an absolute minimum the assorted problems associated with many of the prior art devices which are designed for substantially identical purposes.

Although the present invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by letters patent is:

1. An apparatus for selectively installing a plurality of screw type fasteners comprising:

means for imparting rotational movement to the individual screws about their respective longitudinal axes;

a housing borne on the rotation means and defining a path of travel for the individual screws, the screws traveling from a first, ready position to a second, driving position;

a drive assembly borne by the housing and reciprocally moveable relative thereto, the drive assembly engaged by the rotation means;

a screw engagement assembly borne by the housing and engaged by the drive assembly, and wherein the screw engagement assembly is moveable along a path of travel toward the second, driving position and away from the second driving position, and wherein the screw engagement assembly is operable, when moved toward the second driving position, to urge the individual screws into the second driving position;

a brake borne by the housing and which is operable to releasably engage the screw engagement assembly thereby restraining the screw engagement assembly against motion toward the second, driving position, and when released, permitting movement of the screw engagement assembly toward the second, driving position;

a positioning assembly borne by the housing and operable to releasably secure the individual screws in the second, driving position; and means for releasing the individual screws from the positioning assembly upon engagement of the individual screws with the rotation means.

2. An apparatus, as claimed in claim 1, and wherein the rotation means is a motorized drill having a rotatable bit which releasably engages the head of an individual screw and imparts rotational movement to the screw about its longitudinal axis.

3. An apparatus, as claimed in claim 2, and wherein the housing has first and second portions which form a continuous channel, and which defines an internal cavity, and wherein the first portion defines a first path of travel for the screws, and wherein the second portion defines a second path of travel for the individual screws, the second path of travel terminating in a screw engagement station, and wherein the channel extends from the first portion to the second portion and is operable to matingly receive the heads of individual fasteners.

4. An apparatus, as claimed in claim 3, and wherein the drive assembly includes a bit engagement member which is rotatably mounted in the second portion of the housing and which includes a substantially cylindrical shaped main body having internal and external facing surfaces, and wherein the internal facing surface defines a bore of predetermined dimensions which is operable matingly to receive the bit, and wherein the external surface has formed therein an undulating and substantially continuous groove, and wherein rotation of the bit causes a corresponding rotation of the bit engagement member.

5. An apparatus, as claimed in claim 4, and wherein the drive assembly includes a moveable drive arm which is borne by the housing, and which is engageable with the undulating groove of the bit engagement member, and wherein rotation of the bit engagement member imparts reciprocating motion to the drive arm.

6. An apparatus, as claimed in claim 5, and wherein the drive assembly includes a drive bar which is slideably borne on the housing and which has first and second ends, and inside and outside facing surfaces, and wherein the first end is mounted on the drive arm, and the inside facing surface of the second end has at least one tooth which extends outwardly therefrom.

7. An apparatus, as claimed in claim 6, and wherein the releasable brake has inside and outside facing surfaces and first and second ends, and wherein the first end of the releasable brake is mounted on the outside facing surface of the second end of the drive bar, and the inside surface of the second end of the releasable brake has at least one tooth which extends outwardly therefrom.

8. An apparatus, as claimed in claim 7, and wherein the screw engagement assembly includes a slide assembly borne by the first portion of the housing and having a main body with opposite first and second ends, and left and right peripheral edges, and wherein the left peripheral edge has a rack formed therein which is operable to matingly receive the individual teeth of the drive bar and the releasable brake, respectively, and wherein the right peripheral edge defines first and second engagement surfaces.

9. An apparatus, as claimed in claim 8, and wherein the screw engagement assembly includes an indexing member which is mounted on the first end of the slide assembly and which is rotatable about a predetermined axis, the indexing member operable to engage the head of an individual screw and to urge the screw along the second path of travel and into the driving position.

10. An apparatus, as claimed in claim 9, and wherein the positioning assembly includes a pair of screw positioning arms which are pivotally mounted in the cavity and which are operable to move along individual paths of travel from a first, engaged position wherein each of the screw positioning arms engage the screw thereby positioning the screw in substantially coaxial alignment relative to the bit, to a second, non-engaged position, wherein the individual arms are positioned in spaced relation relative to the screw which is disposed in the driving position.

11. An apparatus, as claimed in claim 10, and wherein the release means includes a locking lug which is slideably mounted in the cavity, and which has a main body which, when disposed in a first, locking position is operable to orient the individual screw positioning arms in the first, engaged position, and wherein the locking lug is moveable to a second, release position wherein the main body is moved out of engagement with the screw positioning arms thereby permitting the individual arms to move along the respective paths of travel to the second, non-engaged position.

12. An apparatus for selectively driving a plurality of screws, which are joined together to form a screw belt, into a work surface, the apparatus comprising:

means for imparting screw threadable rotation to the individual screws;

a housing having a longitudinal line of reference, and which is releasably borne by the rotation means, the housing including first and second housing portions, and defining a channel which is operable to matingly receive and guide the screw belt from the first housing portion toward the second housing portion, and wherein the second housing portion includes a screw engagement station;

a driving assembly borne by the housing and engageable with the rotation means, the driving assembly operable for reciprocating motion along a path of travel which is substantially parallel to the longitudinal line of reference;

a screw engagement assembly slideably borne by the housing and which is engaged by the drive assembly, the screw engagement assembly operable to urge individual screws into the screw engagement station, and wherein the reciprocating motion of the drive assembly urges the screw engagement assembly in a direction away from the screw engagement station;

a releasable brake borne by housing and operable selectively to secure the screw engagement assembly against motion in a direction toward the screw engagement station;

an advancement assembly borne by the housing and operable to engage the screw belt, and wherein movement of the screw engagement assembly away from the screw engagement station causes the advancement assembly to engage the screw belt and urge it in the direction of the screw engagement station;

a severing assembly borne by the housing, and wherein movement of the screw engagement assembly away from the screw engagement station has the effect of causing the severing assembly to sever an individual screw from the screw belt;

a positioning assembly disposed in the screw engagement station and which is operable to releasably position an individual screw which has been received in the screw engagement station in substantially coaxial alignment relative to the rotation means;

a locking assembly positioned in the vicinity of the screw engagement station and which is operable to releasably locate the positioning assembly in a predetermined spatial orientation relative to the screw; and means borne by the housing for retarding movement of the screw belt away from the screw engagement station, and wherein during operation, the rotation means imparts motion to the screw engagement assembly thereby driving it in a direction away from the screw engagement station, and wherein this same movement of the screw engagement assembly simultaneously causes a sequential advancement of the screw belt by means of the advancement assembly and a severing of an individual screw from the screw belt by the severing assembly, and wherein the releasable brake, when released, permits the screw engagement assembly to be moved in a direction toward the screw engagement station thereby engaging the screw which has been severed from the screw belt and advancing the screw into the screw engagement station where it is releasably received by the positioning assembly and subsequently engaged by the rotation means.

13. An apparatus, as claimed in claim 12, and wherein the rotation means is a motorized drill which includes a rotatable bit which is operable to engage the heads of the individual screws.

14. An apparatus, as claimed in claim 13, and wherein the first housing portion defines a first path of travel for the screw belt which is substantially parallel to the longitudinal line of reference, and wherein the second housing portion defines a second path of travel for the individual screws, the second path of travel terminating in the screw engagement station.

15. An apparatus, as claimed in claim 14, and wherein the driving assembly includes a bit engagement member which is rotatably borne by the second portion of the housing and which includes a main body having internal and external facing surfaces, and wherein the internal facing surface defines a bore of predetermined dimensions and which is operable matingly to receive the bit, and wherein the external facing surface has formed therein an undulating and substantially continuous groove, and wherein actuation of the motorized drill causes a corresponding rotation of the bit engagement member.

16. An apparatus, as claimed in claim 15, and wherein the driving assembly includes a drive arm which is borne by the housing and which is engageable with the undulating groove of the bit engagement member, and wherein rotation of the bit engagement member imparts reciprocating motion to the drive arm.

17. An apparatus, as claimed in claim 16, and wherein the driving assembly further includes a drive bar which is slideably borne on the housing and which has first and second ends and inside and outside facing surfaces, and wherein the first end is mounted on the drive arm, and the inside facing surface of the second end has at least one tooth which extends outwardly therefrom.

18. An apparatus, as claimed in claim 17, and wherein the releasable brake has a main body which has inside and outside facing surfaces and first and second ends, respectively, and wherein the first end of the releasable brake is mounted on the second end of the drive bar, and the inside surface of the second end of the releasable brake has at least one tooth which extends outwardly therefrom.

19. An apparatus, as claimed in claim 18, and wherein the screw engagement assembly includes a slide assembly having a main body with opposite first and second ends and left and right peripheral edges, and wherein the left peripheral edge has a rack formed therein, and which is operable to be matingly engaged by the drive assembly, and wherein the right peripheral edge defines first and second engagement surfaces.

20. An apparatus, as claimed in claim 19, and wherein the advancement assembly includes a moveable main body having at least one dog for engaging the screw belt, and wherein the main body of the advancement assembly further includes a moveable member which is engaged by the first engagement surface of the slide assembly, and wherein movement of the slide assembly away from the screw engagement station causes the dog to engage the screw belt and urge it along the first path of travel towards the screw engagement station.

21. An apparatus, as claimed in claim 20, and wherein, the severing assembly includes a slideably mounted cutting blade which is moveable into severing relationship with the screw belt, and wherein a moveable into severing relationship with the screw belt, and wherein a moveable arm is disposed in driving relation relative to the cutter blade and is engaged by the second engagement surface of the slide assembly, and wherein movement of the slide assembly away from the screw engagement station causes the sequential actuation of the screw advancement assembly and the cutter assembly, respectively.

22. An apparatus, as claimed in claim 21, and wherein the screw engagement assembly includes an indexing member which is rotatable about a predetermined axis, and which is operable to engage an individual screw and urge the screw along the second path of travel and into the screw engagement station.

23. An apparatus, as claimed in claim 22, and wherein the positioning assembly includes a pair of screw positioning arms which are pivotally mounted in the screw engagement station, and wherein the screw positioning arms are operable to move along individual paths of travel from a first, engaged position wherein each of the positioning arms are engaged with the screw thereby positioning the screw in substantially coaxial alignment relative to the bit, to a second non-engaged position wherein the individual arms are positioned in spaced relation relative to the individual screw which is received in the screw engagement station.

24. An apparatus, as claimed in claim 23, and wherein the locking assembly includes a locking lug which is slideably borne by the housing, and wherein the locking lug includes a main body which, when disposed in a first, locking position, is operable to engage the screw positioning arms thereby orienting the individual arms in the first, engaged position, and wherein the locking lug is moveable to a second, release position wherein the main body is moved out of engagement with the screw positioning arms thereby permitting the individual arms to move to the second, non-engaged position.

25. An apparatus, as claimed in claim 12, and which further includes a mounting assembly which is operable to slideably mount the housing on the rotation means, and which thereby renders the housing longitudinally moveable relative to the line of reference.

26. An apparatus, as claimed in claim 25, and wherein the mounting assembly includes a stop which is operable to selectively limit the movement of the rotation means relative to the housing.

27. An apparatus for selectively installing a plurality of screws which are joined together in a continuous belt, and wherein the screws include a main body with a first end having a head, and an opposite second end which has a thread which engages a work surface, the apparatus comprising:

means for driving the individual screws into the work surface, and wherein the drive means includes a rotatable bit which releasably engages the head of the screw and imparts rotational movement to the screw about its longitudinal axis;

a housing borne on the drive means and having first and second portions, and an internal cavity, and wherein the first portion defines a first path of travel for the continuous belt of screws, the heads of the individual screws being matingly received in a channel which is formed in the first portion, and wherein the second portion defines a second path of travel for the individual screws, the second path of travel terminating in a screw engagement station;

a bit engagement member rotatably borne by the second portion of the housing and having a substantially cylindrical main body which includes internal and external facing surfaces, and wherein the internal facing surface defines a channel of predetermined dimensions which is operable matingly to receive the bit, and wherein the external surface has formed therein an undulating and substantially continuous channel, and wherein rotation of the bit causes a corresponding rotation of the bit engagement member;

a moveable drive arm borne by the housing and which engages the undulating channel formed in the bit engagement member, and wherein rotation of the bit engagement member imparts reciprocating motion to the drive arm;

a drive bar slideably borne on the housing and having a first end mounted on the drive arm, and an opposite second end, and wherein the drive bar further has inside and outside facing surfaces, and wherein the inside facing surface of the second end has at least one tooth which extends outwardly therefrom;

a releasable brake borne by the housing and having inside and outside facing surfaces and wherein the inside surface of the brake has at least one tooth which extends outwardly therefrom;

a slide assembly borne by the first portion of the housing and disposed in the cavity, the slide assembly having a main body with opposite first and second ends and left and right peripheral edges, and wherein the left peripheral edge has a rack formed therein and which is operable to be matingly engaged by the individual teeth which are made integral with the drive bar and the releasable brake, respectively, and wherein the right peripheral edge defines first and second engagement surfaces;

a screw engagement assembly borne by the housing and disposed in the cavity, the screw engagement assembly mounted on the first end of the slide assembly and including an indexing bar which is rotatable about a predetermined axis and which is operable to engage the head of an individual screw and urge the screw along the second path of travel and into the screw engagement station;

a screw belt advancement assembly borne by the housing and including a moveable main body having at least one dog for engaging the continuous belt of screws, and wherein the main body further includes a moveable member which is engaged by the first engagement surface of the slide assembly, and wherein movement of the slide assembly in a direction away from the screw engagement station has the effect of causing the dog to engage the continuous belt and urge it along the first path of travel towards the screw engagement station;

a screw belt severing assembly borne by the housing and operable to cut the continuous belt between juxtapositioned screws, the severing assembly including a cutting blade which is moveable into and out of severing engagement with the continuous belt, and wherein a moveable arm is disposed in driving relation relative to the cutter blade and is engaged by the second engagement surface of the slide assembly, and wherein movement of the slide assembly in a direction away from the screw engagement station has the effect of causing the sequential actuation of the screw advancement assembly and the severing assembly, respectively;

a pair of screw positioning arms pivotally mounted in the cavity and located in the screw engagement station, the screw positioning arms operable to move along individual paths of travel from a first, engaged position wherein each of the positioning arms are engaged with the screw thereby positioning the screw in substantially coaxial alignment relative to the bit, to a second, non-engaged position, wherein the individual arms are positioned in spaced relation relative to the individual screw which is received in the screw engagement station;

a locking lug slideably mounted in the cavity and including a main body which, when disposed in a first, locking position is operable to orient the individual arms in the first, engaged position, and wherein the locking lug is moveable to a second, release position wherein the main body is moved out of engagement with the screw positioning arms thereby permitting the individual arms to move along the path of travel to the second, non-engaged position;

means for selectively urging the locking lug from the first, locking position, to the second, release position; and means borne by the housing for retarding movement of the continuous belt in a direction away from the screw engagement station, and wherein upon rotation of the bit, reciprocal motion is imparted to the drive bar by way of the drive arm which is disposed in driving relation relative to bit engagement member, and wherein the reciprocal motion of the drive bar is operable, by way of the tooth, to engage the rack of the slide assembly thereby driving the slide assembly in a direction away from the screw engagement station, and wherein the movement of the slide assembly has the simultaneous effect of sequentially advancing the continuous belt along the first path of travel by means of the screw advancement assembly and sequentially cutting the continuous belt by means of the severing assembly, and wherein the actuator of the releasable brake permits the slide assembly to be moved in a direction toward the screw engagement station thereby causing the indexing bar to engage a screw which has been severed from the continuous belt and advance it into the screw engagement station.

* * * * *

UNITED STATES PATENT AND TRADEMARK OFFICE

CERTIFICATE OF CORRECTION

PATENT NO. : 5,144,870

DATED : September 8, 1992

INVENTOR(S) : Edward V. Nick

It is certified that error appears in the above—identified patent and that said Letters Patent is hereby corrected as shown below:

In Column 14, Line 64, delete "mean" and substitute therefore --- means --- .

In Column 15, Line 24, delete "28" and substitute therefore --- 280 --- .

In Column 17, Line 28, delete "13" and substitute therefore --- 413 --- .

In Column 18, Line 45, delete "13" and substitute therefore --- 130 --- .

In Claim 21, Column 28, Lines 18-19, delete "into severing relationship with the screw belt, and wherein a movable".

Signed and Sealed this

Fourteenth Day of September, 1993

Bruce Lehman

*Attest:*

BRUCE LEHMAN

*Attesting Officer*

*Commissioner of Patents and Trademarks*